US005143015A

United States Patent [19]

Lubitz et al.

[11] Patent Number: 5,143,015

[45] Date of Patent: Sep. 1, 1992

[54] COILED TUBING SET INFLATABLE PACKER, BRIDGE PLUG AND RELEASING TOOL THEREFOR

[75] Inventors: Eric P. Lubitz, Hartsville, S.C.; Scott T. MacLaughlin, Royal Palm Beach, Fla.

[73] Assignee: Halliburton Company, Duncan, Okla.

[21] Appl. No.: 643,297

[22] Filed: Jan. 18, 1991

[51] Int. Cl.[5] ..... E21B 33/127

[52] U.S. Cl. ..... 166/187; 166/182; 277/34

[58] Field of Search ..... 166/187, 181, 182, 192, 166/385; 277/34, 34.6

[56] References Cited

U.S. PATENT DOCUMENTS

| | | | |
|---|---|---|---|
| 2,976,076 | 3/1961 | Farley | 294/102 |
| 3,189,096 | 6/1965 | Phenix | 166/133 |
| 3,246,964 | 1/1968 | Brandell | 166/106 |
| 3,386,764 | 6/1968 | Evans | 294/86.1 |
| 3,500,909 | 3/1970 | Beyer | 166/134 |
| 3,524,501 | 8/1970 | Armstrong | 166/182 |
| 3,584,684 | 6/1971 | Anderson | 166/129 |
| 4,175,778 | 11/1979 | Nunez et al. | 285/3 |
| 4,355,685 | 10/1982 | Beck | 166/240 |
| 4,768,590 | 9/1988 | Sanford et al. | 166/187 |
| 4,796,707 | 1/1989 | Halbardier | 166/187 X |
| 4,869,325 | 9/1989 | Halbardier | 166/187 X |
| 4,934,460 | 6/1990 | Coronado | 166/187 X |
| 4,953,617 | 9/1990 | Ross et al. | 166/187 |
| 5,020,592 | 6/1991 | Muller et al. | 166/187 |

OTHER PUBLICATIONS

"Thru-Tubing Straddle Packer Expands, Seals In Casing", Ocean Industry, Feb. 1989, pp. 44-45.

Tam International Publication "Tam-J Inflatable Workover/Testing Packers And Accessories Ordering Guide-Jan. 1986".

Tam International Publication "Tam-J Heavy-Duty Inflatable Packers For Well Testing, Workovers, and Production" (1986).

Lynes 1978-1979 Catalog, pp. 18, 19, 22 and 23.

*Primary Examiner*—William P. Neuder

*Attorney, Agent, or Firm*—James R. Duzan; Neal R. Kennedy

[57] ABSTRACT

A coiled tubing set inflatable packer, bridge plug and releasing tool therefor. The packer and bridge plug comprise an adapter with a mandrel slidably disposed therein. A pressure actuated piston releases a locking ball between the mandrel and adapter during an inflation cycle and allows movement of the mandrel such that the locking ball again locks the mandrel and adapter when the mandrel is moved to a sealed position wherein the inflatable packer element is sealingly closed. The inflatable packer of the present invention comprises a valve for opening a central passageway through the packer. A J-slot in the packer allows a plurality of inflation cycles to insure proper setting of the packer prior to actuation of the valve. The bridge plug of the present invention comprises a bypass passage therethrough which may be opened by upward movement of a central mandrel. A releasing tool is provided for releasing the packer or bridge plug in the well bore after setting of the packer element. A releasing plug or releasing ball is used to move a releasing mandrel and disengage locking dogs from an overshot on the releasing tool so that the releasing tool may be removed from the well bore.

36 Claims, 9 Drawing Sheets

COILED TUBING SET INFLATABLE PACKER, BRIDGE PLUG AND RELEASING TOOL THEREFOR

BACKGROUND OF THE INVENTION

1. Field Of The Invention

This invention relates to packers and bridge plugs for use in a well bore, and more particularly, to an inflatable packer and bridge plug, along with a releasing tool therefor.

2. Brief Description Of The Prior Art

During the life of an oil or gas well, it is often desirable to perform treating operations on some subsurface zone of the well. Such operations can be very costly because they involve moving and setting up expensive equipment. For example, when workover or squeeze cementing operations are performed on an existing oil or gas well, a drilling or workover rig must be moved onto the location. Moving such equipment always involves a sizable expense to the operating company. This is especially true when a well is located in a remote area such as the North Slope of Alaska, the North Sea and the Mid East. In these locations, the expense of moving the drilling o workover rig often exceeds the value of benefits gained from the service.

Also, when squeeze cementing, treating, fracturing and other services are performed on wells, it is necessary to take the costly step of removal of production tubing from the well during the treatment. Accordingly, this high workover cost creates the need for tools which can be run on small diameter coiled tubing and which can pass through production tubing and other equipment and be set with work string pressure inside the casing. This is particularly desirable on deviated wells, but is also desirable on straight wells.

The present invention meets these needs by providing a coiled tubing set inflatable packer and a bridge plug. Also included in the invention is a releasing tool which allows the packer and bridge plug to be released and left in the well bore when necessary or desired.

A problem with prior art inflatable packers is that they might not properly set, and if this occurs in some cases, the packer must be removed and retrimmed. The inflatable packer portion of the present invention solves this problem by providing an indexing J-slot design which permits a plurality of attempts at setting the packer. On the final pressure cycle, a J-slot mandrel shifts down to open a valve in the tool.

SUMMARY OF THE INVENTION

The present invention comprises a coiled tubing set inflatable packer and bridge plug. The apparatus further comprises a releasing tool for releasing either the packer or the bridge plug after positioning in a well.

The invention may be described as a downhole inflatable packing apparatus comprising an adapter means for connecting to a coiled tubing set and defining an inflation port therein, mandrel means for sliding within the adapter means and defining an inflation port therein aligned with the inflation port on the adapter means when in an inflation position, and an inflatable packer element attached to the adapter means and adapted for inflation by fluid pumped through the aligned inflation ports when the mandrel means is in the inflation position. The mandrel means is movable to a sealed position when weight is applied thereto wherein the inflation port in the mandrel means is unaligned with the inflation port in the adapter means. The apparatus further comprises pressure actuating releasing and locking means for releasing the mandrel means from the inflation position, thereby allowing movement of the mandrel means to the sealed position and for locking the mandrel means in this sealed position.

The releasing and locking means may be characterized by a piston slidably disposed in the adapter means, biasing means for biasing the piston toward an initial position thereof with respect to the adapter means, a locking ball engaged by the piston and held thereby in one groove defined in the mandrel means for locking the mandrel means in the inflated position. When pressure is applied to the piston, the piston is moved toward the biasing means such that the ball is freed from the one groove, and the mandrel means is freed from movement to the sealed position wherein the ball is aligned with another groove defined in the mandrel means. When pressure is relieved from the piston, the biasing means moves the piston toward the initial position such that the ball is held in the other groove for locking the mandrel means in the sealed position. The apparatus may further comprise shearing means for shearably holding the piston in the initial position.

In one embodiment, the adapter means defines an annular volume therein, and the piston and biasing means are disposed in this annular volume. The adapter means may define a hole therethrough for providing communication between the annular volume and a well annulus.

The adapter means defines an opening therethrough adjacent to the piston in which the ball is at least partially disposed. The adapter means further defines a piston port therein in communication with the annular volume, and the mandrel means defines a piston port therein aligned with the piston port in the adapter means when the mandrel means is in the inflation position. Pressure is applied to the piston through the aligned piston ports.

The apparatus preferably further comprises sealing means between the piston and the adapter means. Also, means may be provided for limiting movement of the mandrel means with respect to the adapter means. In the preferred embodiment, this means comprises a lug on the adapter means extending into a slot in the mandrel means. The length of the slot limits the movement of the mandrel means.

The inflatable packer of the present invention comprises the adapter means, the mandrel means, the inflatable packer element, and also comprises valve means below the packer element for opening a central passage through the packer when actuated, and pressure responsive J-slot means for allowing a plurality of inflation cycles and further allowing actuation of the valve means after this plurality of inflation cycles. The above-described movement of the mandrel means from the inflation position to the sealed position occurs during an inflation cycle.

The J-slot means preferably comprises a J-slot case attached to the packer element, a J-slot piston slidably disposed in the J-slot case wherein one of the J-slot case and piston define a J-slot thereon, and a J-slot retained by the other of the J-slot case and piston. The J-slot ball engages the J-slot. The J-slot has a plurality of legs corresponding to the plurality of inflation cycles and a relatively longer leg corresponding to a position allowing actuation of the valve means. Biasing means may be provided in the J-slot means for biasing the J-slot piston toward the packer element.

In one embodiment, the J-slot case and the mandrel means define an annular volume therebetween, and the J-slot piston is positioned in this annular volume. Also, the biasing means may be positioned in this annular volume. The J-slot case may define a port therethrough for providing communication between the annular volume and the well annulus.

The mandrel means further defines a pressure port therethrough for providing communication between the annular volume and the central opening through the packer. The J-slot moves in response to pressure of fluid pumped from the central opening through the pressure port.

The valve means comprises operating mandrel means for actuating the valve means to an open position thereof, and initially, the J-slot case is locked with respect to the operating mandrel means. The J-slot means further comprises releasing means for releasing the operating mandrel means from the J-slot case. The apparatus further comprises biasing means for biasing the operating mandrel means to the open position when released from the J-slot case.

A J-slot mandrel preferably extends from the J-slot piston and defines a substantially transverse mandrel opening therethrough. The J-slot case preferably defines a substantially transverse case opening therethrough initially longitudinally spaced from the mandrel opening. The operating mandrel means comprises a retainer defining a retainer opening therethrough initially aligned with a case opening. The apparatus further comprises inwardly biasing locking dog means initially disposed in the case opening and the retainer opening and biased toward the J-slot mandrel. After sufficient movement of the J-slot piston with respect to the J-slot case, which corresponds to the J-slot ball being positioned in the longer leg of the J-slot, the mandrel opening is aligned with the retainer opening such that the locking dog means moves inwardly for engaging the mandrel opening and disengaging from the case opening. In this way, the operating mandrel means is released with respect to the J-slot case.

The locking dog means preferably comprises at least one spring biased locking dog. The biasing means used for biasing the operating mandrel means is preferably characterized by a spring disposed in the J-slot case.

The valve means in the packer may be characterized as a ball valve or other valve means known in the art.

The inflatable bridge plug apparatus of the present invention comprises the adapter means and mandrel means as previously described. In the bridge plug, the mandrel means further defines an upper bypass port therein, and the mandrel means is further movable to a bypass position wherein the upper bypass port in the mandrel means is aligned with an upper bypass port in the adapter means. The bridge plug comprises bypass means for sliding in the adapter means and defining an inflation port therein aligned with the inflation ports in the mandrel means and adapter means when in an inflation position. The bypass means also defines a deflation port therein alignable with the inflation port in the mandrel means when the mandrel means is in the sealed position. The bypass means further defines a lower bypass port therein aligned with the lower bypass port in the adapter means when in the bypass position. After setting of the bridge plug, unsetting is accomplished by lifting on the bypass means which aligns the upper bypass ports and further aligns the lower bypass ports so that pressure is equalized above and below the sealed packer element. Further lifting allows deflation of the packer element.

The bridge plug may further comprise a collet extending from the bypass means, and a releasing mandrel disposed in the mandrel means for engaging the collet when the mandrel means is in the sealed position. The subsequent lifting force applied to the mandrel means after engagement will move the mandrel means and the bypass means to the bypass positions thereof. The releasing mandrel may be actuated by a releasing ball which moves the releasing mandrel into engagement with the collet when pressure is applied above the releasing mandrel and releasing ball.

Locking means may be provided for locking the releasing mandrel with respect to the mandrel means after the releasing mandrel is engaged with the collet.

The bridge plug apparatus further comprises equalizing means for equalizing pressure in the bypass means with pressure in the well annulus as the bridge plug is run into the well bore. This equalizing means comprises the adapter means and bypass means defining an annular volume therebetween. The adapter means defining an equalizing port therethrough adjacent to a longitudinal end of the annular volume for providing communication between the annular volume and the well annulus, the bypass means defining an equalizing port therethrough adjacent to an opposite longitudinal end of the annular volume for providing communication between the annular volume and a central opening through the bridge plug, and an equalizing piston disposed in the annular volume between the equalizing ports. A means may be provided for limiting longitudinal movement of the equalizing piston.

In addition to the packer and bridge plug of the apparatus, the present invention comprises a releasing apparatus for such downhole tools. The releasing apparatus comprises a neck portion for connecting to the downhole tool and defining a substantially transverse opening therethrough, releasing mandrel means for sliding within the neck portion and defining a mandrel groove in an outer portion thereof which is initially spaced from the opening in the neck portion, overshot means disposed around the neck portion for connecting to a coiled tubing unit and defining an overshot groove therein, locking dog means disposed in the opening for initially engaging the overshot groove, and releasing means for engaging and moving the releasing mandrel means. When the releasing mandrel means is so moved, the mandrel groove is aligned with the opening such that the locking dog means is aligned therewith. The locking dog means comprises biasing means for biasing the locking dog means inwardly towards the releasing mandrel means so that the locking dog means engages the mandrel groove and is disengaged from the overshot groove, thereby releasing the overshot means from the neck portion. The locking dog means preferably comprises a spring biased locking dog.

The releasing apparatus further comprises shearing means for shearably attaching the releasing mandrel means to the neck portion.

The releasing means may be characterized by a releasing ball or by a releasing plug. In the embodiment shown, the releasing plug latchingly engages the releasing mandrel means and has a flexible portion therein.

The neck portion of the releasing apparatus comprises a retrieving neck engageable by a downhole retrieving tool of a kind known in the art.

It is an important object of the present invention to provide a downhole packing apparatus, such as a packer or bridge plug, which may be set in position in the well at the end of a coiled tubing unit.

Another object of the invention is to provide an inflatable packing apparatus which has a pressure actuated releasing and locking means for locking the apparatus in an inflated position.

An additional object of the present invention is to provide an inflatable packer which allows a plurality of inflation cycles so that several attempts may be made to set the packer before actuating a valve means therein.

Still another object of the present invention is to provide an inflatable bridge plug which, during a removal operation, equalizes pressure above and below the inflated packing element.

A further object of the present invention is to provide a releasing tool for releasing a packer, bridge plug or other downhole tool from a coiled tubing unit in a well.

Additional objects and advantages of the invention will become apparent as the following detailed description of the preferred embodiments is read in conjunction with the drawings which illustrate such preferred embodiments.

BRIEF DESCRIPTION OF THE DRAWINGS

FIGS. 1A–1J show a longitudinal cross section of the coil tubing set inflatable packer of the present invention.

DESCRIPTION OF THE PREFERRED EMBODIMENT

Figure 1A:
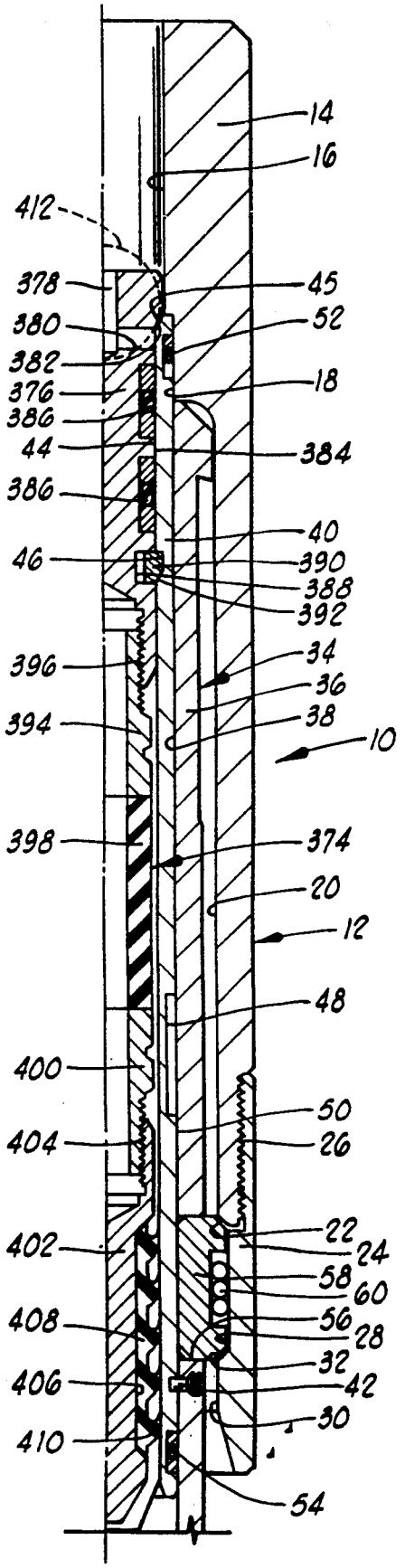

The apparatus of the present invention comprises a coil tubing set inflatable packer and a coil tubing set inflatable bridge plug. The invention further comprises a releasing tool for the packer, bridge plug or similar downhole tool.

Packer

Referring now to the drawings, and more particularly to FIGS. 1A–1J, the coil tubing set inflatable packer of the present invention is shown and generally designated by the numeral 10. At the upper end of packer 10 is a releasing tool 12 which is used to run the packer into a well bore and is also used to leave the packer downhole when desired, as will be further described herein.

Referring now to FIG. 1A, releasing tool 12 comprises an overshot 14 which is connected at its upper end to a coiled tubing unit (not shown) in a manner known in the art. Overshot 14 has a first bore 16, second bore 18 and third bore 20 defined therein which are progressively larger. At the lower end of overshot 14 is an internal chamfered shoulder 22.

The lower end of overshot 14 is attached to an overshot retainer 24 at threaded connection 26. Overshot retainer 24 has a first bore 28 and a slightly smaller second bore 30 therein. A chamfered shoulder 32 interconnects first and second bores 28 and 30.

Releasing tool 12 is disposed around the upper end of a mandrel means 34. This upper end of mandrel means 34 is preferably characterized by a retrieving head 36 which has a first bore 38 therein. It will be seen that first bore 38 in retrieving head 36 and second bore 18 in overshot 14 are substantially the same size and aligned with one another.

Disposed in second bore 18 of overshot 14 and first bore 38 of retrieving head 36 is a releasing mandrel 40. Releasing mandrel 40 is slidably disposed in overshot 14 and retrieving head 36 and is initially held in the position shown by a shear pin 42.

Releasing mandrel 40 has a bore 44 therethrough with a chamfer 45 at the upper end thereof. A locking ring groove 46 is defined in bore 44. A locking dog groove 48 is defined in outer surface 50 of releasing mandrel 40.

Sealing engagement is provided between overshot 14 and the upper end of releasing mandrel 40 by an upper sealing means, such as seal 52. Similarly, sealing engagement is provided between retrieving head 36 and the lower end of releasing mandrel 40 by a lower sealing means, such as seal 54 below shear pin 42.

Defined transversely through retrieving head 36 are a plurality of locking dog openings 56 which are circumferentially spaced around the retrieving head. A locking dog 58 is disposed in each locking dog opening 56. Each locking dog 58 is biased against outer surface 50 of releasing mandrel 40 by a biasing means, such as a spring 60. It will be seen that locking dogs 58 are positioned longitudinally between, and retained by, shoulder 22 on overshot 14 and shoulder 32 in overshot retainer 24.

Figure 1B:
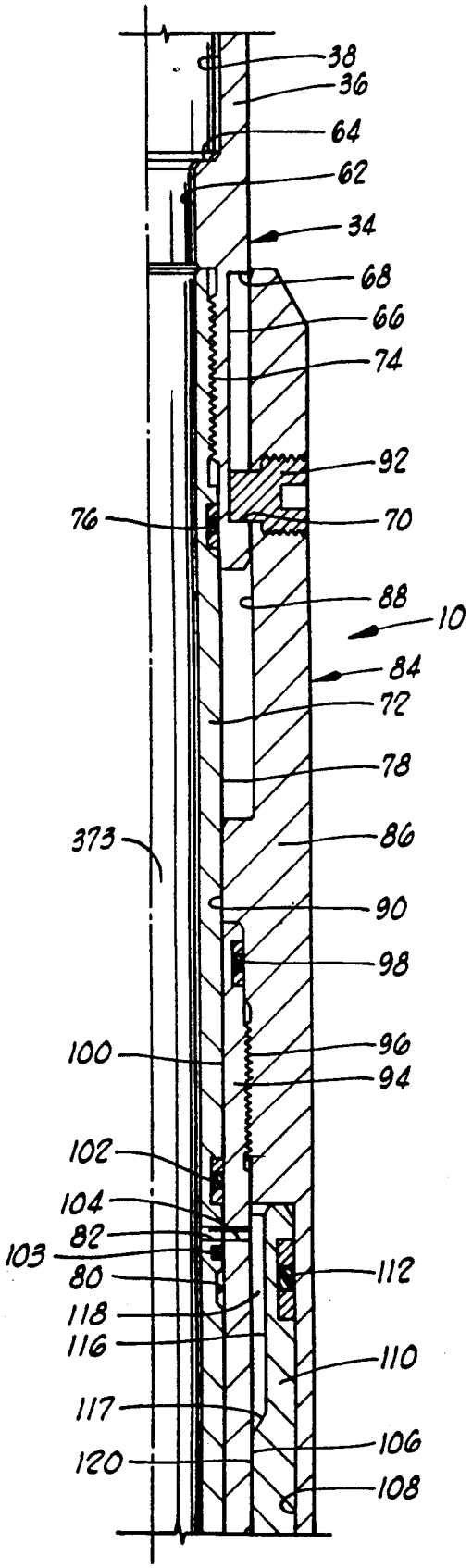

Referring now to FIG. 1B, retrieving head 36 also has a second bore 62 therein. An upwardly facing, annular shoulder 64 extends between second bore 62 and first bore 38 of retrieving head 36.

A longitudinally extending slot 66, having an upper end 68 and a lower end 70, is defined in the lower outer portion of retrieving head 36.

The lower end of retrieving head 36 is attached to an inner mandrel 72 at threaded connection 74. Inner mandrel 72 is thus part of mandrel means 34. A sealing means, such as seal 76, provides sealing engagement between retrieving head 36 and inner mandrel 32.

Inner mandrel 72 has an outer surface 78 in which is defined a shallow annular upper groove 80. Extending transversely through inner mandrel 72 above groove 80 is a piston port 82.

Disposed around mandrel means 34 is an adapter means 84. At the upper end of adapter means 84 is an upper adapter 86 having a first bore 88 and a smaller second bore 90 therein. First bore 88 is adapted for slidingly receiving the lower end of retrieving head 36.

A retaining lug 92 is attached to upper adapter 86 and extends into slot 66 in retrieving head 36. It will be seen by those skilled in the art that longitudinal movement between mandrel means 34 and adapter means 84 is possible, while relative rotation therebetween is thus prevented.

Second bore 90 in upper adapter 86 is adapted for slidingly receiving outer surface 78 of inner mandrel 72.

Below second bore 90, upper adapter 86 is attached to a packer body 94 at threaded connection 96. A sealing means, such as seal 98, provides sealing engagement between upper adapter 86 and packer body 94.

Packer body 94 has a bore 100 in which outer surface 78 of inner mandrel 72 is slidably disposed. A sealing means, such as seals 102 and 103, provides sliding, sealing engagement between inner mandrel 72 and packer body 94 on opposite sides of piston port 82.

Packer body 94 defines a transverse piston port 104 therethrough which is initially aligned with piston port 82 in inner mandrel 72.

Figure 1C:
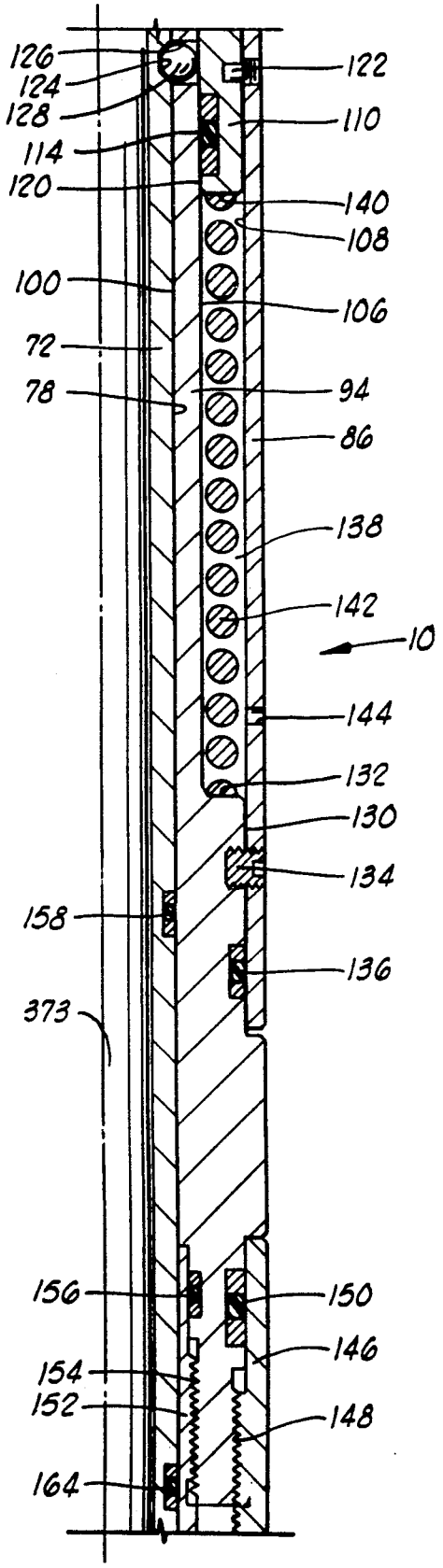

Referring now to FIGS. 1B and 1C, packer body 94 has a first outer surface 106, and upper adapter 86 has a third bore 108 therein which is spaced radially outwardly from first outer surface 106 such that an annular volume is defined therebetween. Slidably disposed in this annular volume is a mandrel locking piston 110. Sealing engagement is provided between piston 110 and third bore 108 in upper adapter 86 by an upper sealing means, such as seal 112. Similarly, sealing engagement is provided between piston 110 and first outer surface 106 of packer body 94 by a lower sealing means, such as seal 114.

Piston 110 has a first bore 116 therein with a chamfer 117 at the lower end thereof. First bore 116 is spaced radially outwardly from first outer surface 106 of packer body 94 such that an annular recess 118 is defined therebetween. Piston 110 also has a smaller second bore 120 therethrough which is adapted for close, sliding relationship with outer surface 106 of packer body 94.

Still referring to FIG. 1C, piston 110 is initially locked with respect to upper adapter 86 by a shear pin 122.

Inner mandrel 72 defines a lower groove 124 therein which is spaced below upper groove 80. Upper groove 80 is shallower than lower groove 124.

Packer body 94 defines a transverse hole 126 therein which is initially aligned with lower groove 124 in inner mandrel 72. A locking ball 128 is positioned in hole 126 and extends into lower groove 124. Radially outward movement of ball 128 is prevented by second bore 120 in piston 110. Thus, it will be seen by those skilled in the art that when piston 110 and ball 128 are in the shown position, relative longitudinal movement between inner mandrel 72 and packer body 94 is prevented.

Still referring to FIG. 1C, packer body 94 has a second outer surface 130 which fits closely within third bore 108 in upper adapter 86. An annular shoulder 132 extends between first outer surface 106 and second outer surface 130 of packer body 94.

The lower end of upper adapter 86 is attached to packer body 94 by a set screw 134. A sealing means, such as seal 136, provides sealing engagement between upper adapter 86 and packer body 94.

An annular volume 138 is defined radially between first outer surface 106 of packer body 94 and third bore 108 in upper adapter 86 and longitudinally between shoulder 132 on the packer body and lower end 140 of piston 110. A biasing means, such as a spring 142, is disposed in annular volume 138. Spring 142 bears on shoulder 132 and lower end 140 for biasing piston 110 in an upward direction.

Upper adapter 86 defines a substantially transverse hole 144 therethrough which provides communication between annular volume 138 and the well annulus.

The lower end of packer body 94 is attached on its outer side to an upper packer coupling 146 at threaded connection 148. A sealing means, such as seal 150, provides sealing engagement between packer body 94 and upper packer coupling 146.

The lower end of packer body 94 is attached on its inside to a packer mandrel 152 at threaded connection 154. A sealing means, such as seal 156, provides sealing engagement between packer body 94 and packer mandrel 152.

Another sealing means, such as seal 158, provides sealing engagement between inner mandrel 72 and packer body 94 below ball 128.

Figure 1D:
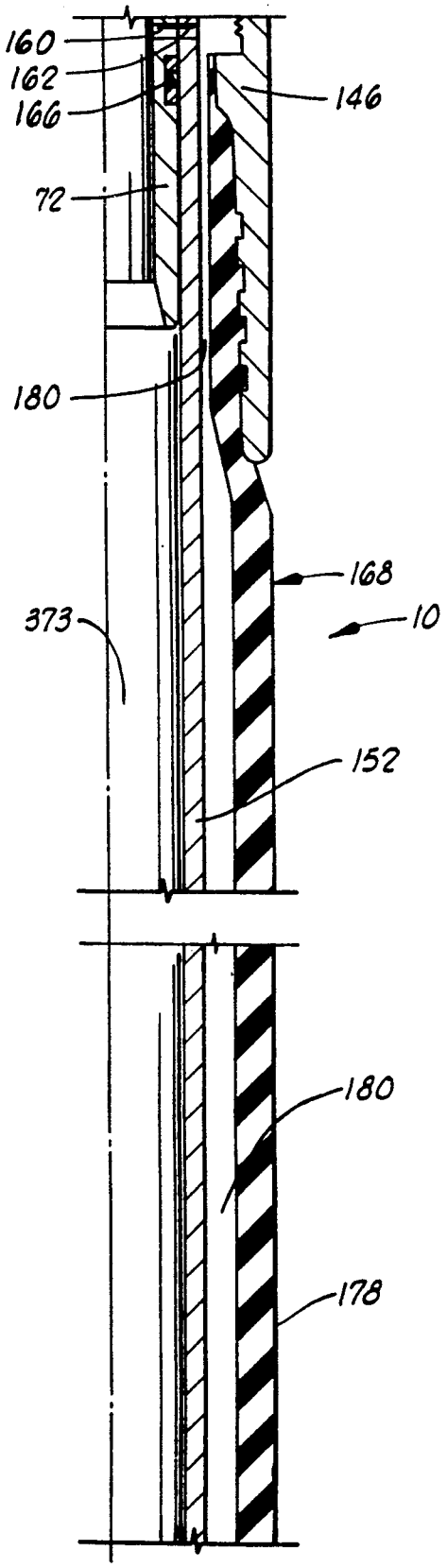

Referring now to FIGS. 1C and 1D, inner mandrel 72 defines a transverse inflation port 160 therethrough which is initially aligned with another transverse inflation port 162 defined through packer mandrel 152.

A sealing means, such as seal 164, provides sealing engagement between inner mandrel 72 and packer mandrel 152 above ports 160 and 162. Another sealing means, such as seal 166, provides sealing engagement between inner mandrel 72 and packer mandrel 152 below ports 160 and 162

The upper end of an inflatable packer element 168 is connected to upper packer coupling 146 in a manner known in the art. Packer element 168 itself is of a kind generally known in the art.

Figure 1E:
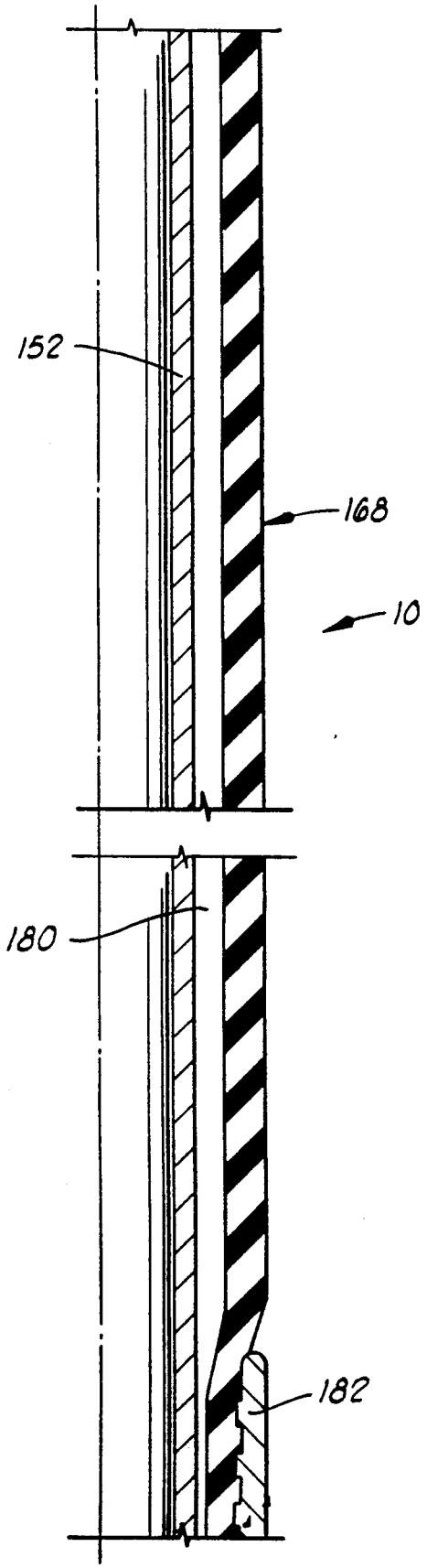

Referring to FIGS. 1D and 1E, a packer annulus 180 is defined between packer mandrel 152 and packer element 168. Packer annulus 180 is in communication with inflation port 162 in packer mandrel 152.

Figure 1F:
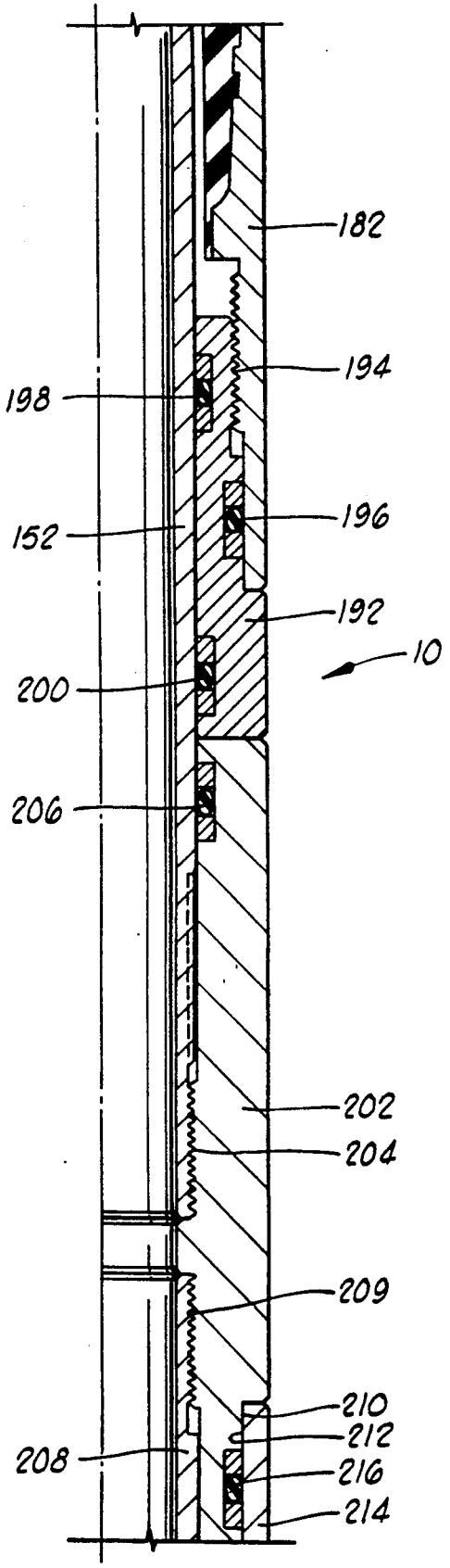

Referring now to FIGS. 1E and 1F, the lower end of packer element 168 is attached to a lower packer coupling 182 which may be substantially identical to upper packer coupling 146.

Referring to FIG. 1F, the lower end of lower packer coupling 182 is attached to a floating shoe 192 at threaded connection 194. A sealing means, such as seal 196, provides sealing engagement between lower packer coupling 182 and floating shoe 192.

A sealing means, such as a pair of seals 198 and 200, provides sealing engagement between packer mandrel 152 and floating shoe 192.

The lower end of packer mandrel 152 is attached to center coupling 202 at threaded connection 204. Sealing engagement is provided between packer mandrel 152 and center coupling 202 by a sealing means, such as seal 206. It will be seen that the upper end of center coupling 202 is adjacent to the lower end of floating shoe 192.

The lower end of center coupling 202 is attached on its inside to a J-slot mandrel 208 at threaded connection 209.

The lower end of center coupling 202 has an outer surface 210 which fits closely within a bore 212 in a J-slot case 214. A sealing means, such as seal 216, provides sealing engagement between center coupling 202 and J-slot case 214.

Figure 1G:
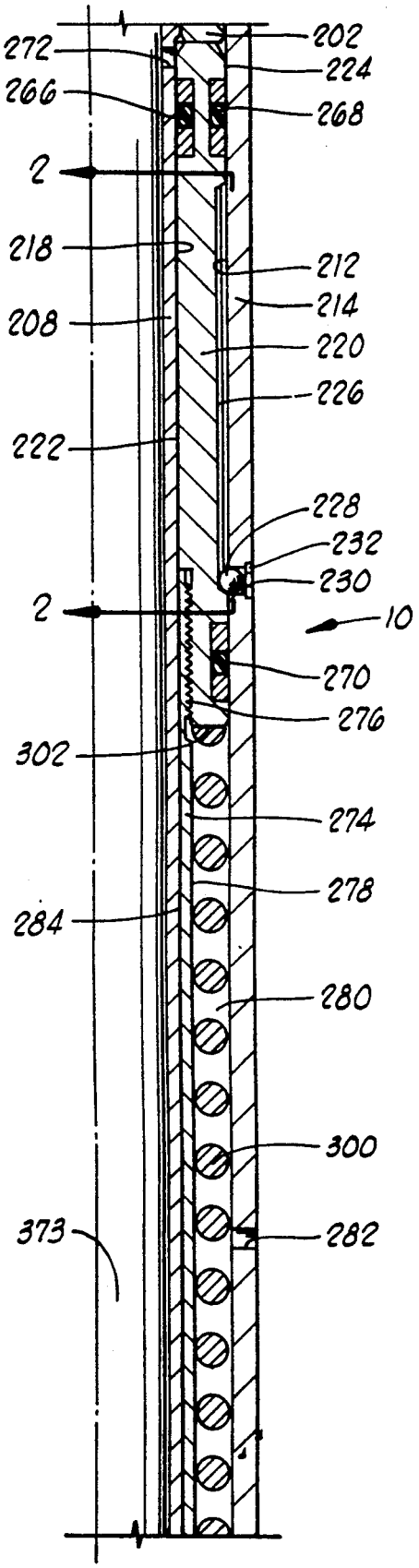

Referring now to FIG. 1G, J-slot mandrel 208 has an outer surface 218 thereon which is spaced radially inwardly from bore 212 in J-slot case 214 such that an annular volume is defined therebetween. A J-slot piston 220 is slidably and rotatably disposed in this annular volume. J-slot piston 220 has a bore 222 therethrough which is in close relationship to outer surface 218 of J-slot mandrel 208. J-slot piston 220 also has an outer surface 224 which is in close relationship with bore 212 in J-slot case 214.

A J-slot 226 is defined in outer surface 224 of J-slot piston 220. A ball 228 is disposed in transverse opening 230 in J-slot case 214 and is retained in place by a keeper and retainer 232. Ball 228 will be seen to engage J-slot 226.

Figure 2:
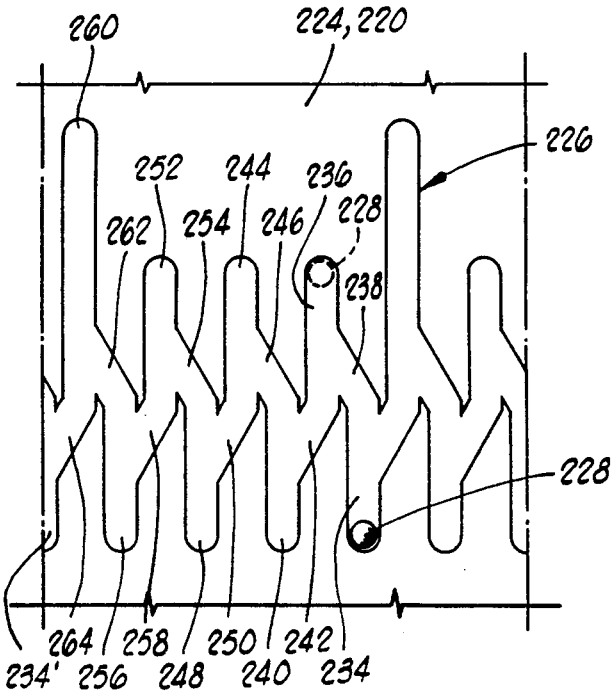
FIG. 2 is a view of a J-slot portion of the apparatus as seen along lines 2—2 in FIG. 1G.

Referring now to FIG. 2, an elevational view of J-slot 226 is shown. J-slot 226 comprises a downwardly extending first leg 234 connected to an upwardly extending second leg 236 by a transition portion 238, a downward third leg 240 connected to second leg 236 by transition portion 242, an upward fourth leg 244 connected to third leg 240 by a transition portion 246, a downward fifth leg 248 connected to fourth leg 244 by a transition portion 250, an upward sixth leg 252 connected to fifth leg 248 by a transition portion 254, a downward seventh leg 256 connected to sixth leg 252 by a transition portion 258, and an upward, long eighth leg 260 connected to seventh leg 256 by a transition portion 262. This pattern may be repeated around J-slot piston 220 as desired. In this way, long eighth leg 260 is connected to another first leg 234' by a transition portion 264. The operation of J-slot 226 will be further described herein.

Referring again to FIG. 1G, an inner sealing means, such as seal 266, provides sealing engagement between J-slot piston 220 and J-slot mandrel 208. Outer sealing means, such as upper seal 268 and lower seal 270, provide sealing engagement between J-slot piston 220 and J-slot case 214 above and below J-slot 226.

A substantially transverse J-slot port 272 is defined through J-slot mandrel 208 above seals 266 and 268. Port 272 is thus in communication with an upper portion of J-slot piston 220.

The lower end of J-slot piston 220 is attached to a releasing sleeve 274 at threaded connection 276. Releasing sleeve 274 has an outer surface 278 thereon which is spaced radially inwardly from bore 212 in J-slot case 214 such that an annular volume 280 is defined therebetween. A transverse port 282 is defined through J-slot case 214 and provides communication between annular volume 280 and the well annulus.

Releasing sleeve 274 has a bore 284 therethrough which is slidingly and rotatably disposed on outer surface 218 of J-slot mandrel 208.

Figure 1H:
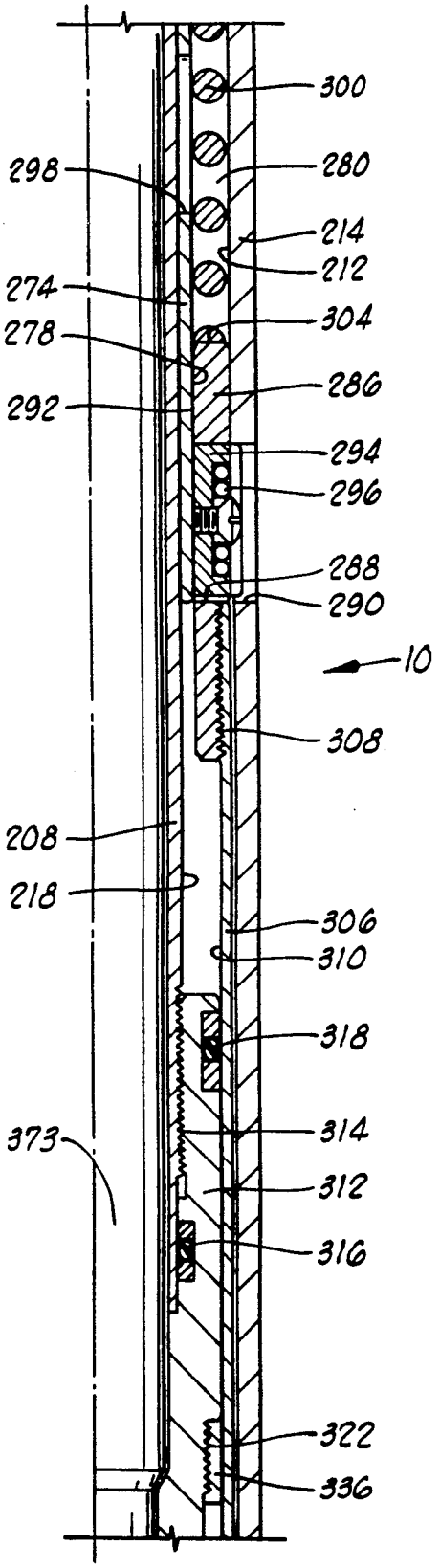
Figure 11:
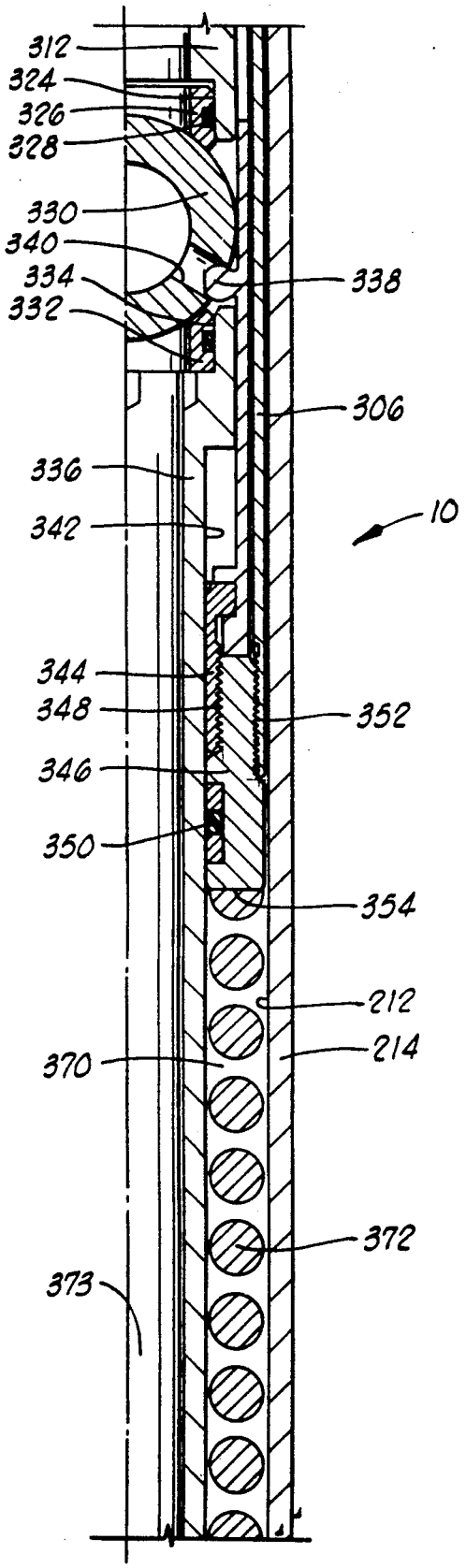

Referring to FIG. 1H, a locking dog retainer 286 is disposed in bore 212 of J-slot case 214. Locking dog retainer 286 defines a plurality of locking dog windows or openings 288 therethrough which are initially aligned with outer locking dog windows or openings 290 in J-slot case 214. The lower end of outer surface 278 of releasing sleeve 274 fits in a bore 292 defined in locking dog retainer 286.

A locking dog 294 is disposed in each locking dog window 288 and biased radially inwardly against outer surface 278 of releasing sleeve 274 by a biasing means, such as spring 296.

Inner locking dog windows are defined transversely through releasing sleeve 274. Inner locking dog windows 298 are initially spaced above locking dogs 294.

Referring to FIGS. 1G and 1H, a biasing means, such as spring 300, is disposed in annular volume 280 and bears against lower end 302 of J-slot piston 220 and upper end 304 of locking dog retainer 286.

The lower end of locking dog retainer 286 is attached to a ball valve operating mandrel 306 at threaded connection 308. Operating mandrel 306 defines a bore 310 therethrough.

The lower end of J-slot mandrel 208 is attached to an upper seat holder 312 at threaded connection 314. A sealing means, such as seal 316, provides sealing engagement between J-slot mandrel 208 and upper seat holder 312.

Upper seat holder 312 fits closely within bore 310 of operating mandrel 306, and a sealing means, such as seal 318, provides sealing engagement therebetween. Upper seat holder 312 is attached to ball valve cage or mandrel 336, described below, at threaded connection 322.

Referring now to FIG. 1I, the lower end of upper seat holder 312 defines a counterbore 324 therein, and an upper ball valve seat 326 is disposed in the counterbore. A sealing means, such as an 0-ring 328, provides sealing engagement between upper seat 326 and counterbore 324. A ball valve 330, of a kind known in the art, is disposed between upper seat 326 and a lower ball valve seat 332.

Lower seat 332 is disposed in a corresponding counterbore 334 in ball valve cage or mandrel 336.

An operating pin 338 is slidably disposed in ball valve cage 336 adjacent to ball 330. Operating pin 338 engages a hole 340 in ball 330.

Cage 336 has an outer surface 342 thereon. An operating pin retainer 344 is slidably disposed on outer surface 342 and engages the lower end of operating pin 338. The lower end of operating pin retainer 344 is attached to the inside of an operating mandrel cap 346 at threaded connection 348. A sealing means, such as seal 350, provides sealing engagement between operating mandrel cap 346 and outer surface 342 of cage 336.

The lower end of operating mandrel 306 is attached to the outside of operating mandrel cap 346 at threaded connection 352. Operating mandrel cap 346 has a downwardly facing lower end 354.

Figure 1J:
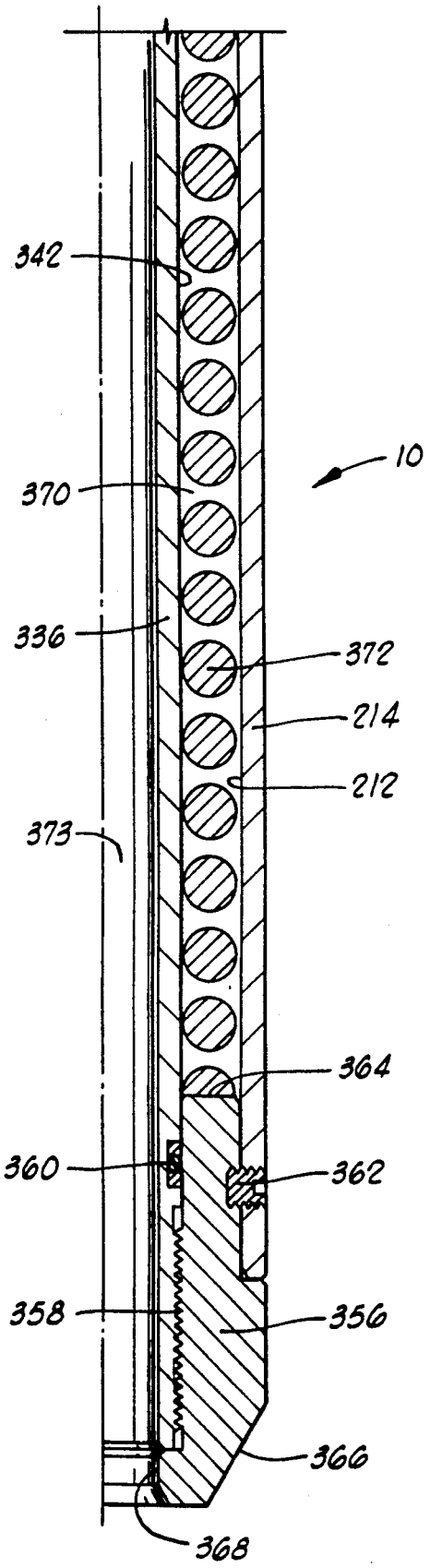

Referring now to FIG. 1J, the lower end of ball valve cage 336 is attached to a lower adapter 356 at threaded connection 358. A sealing means, such as a seal 360, provides sealing engagement between cage 336 and lower adapter 356. The lower end of J-slot case 214 is attached to an outer portion of lower adapter 356 by a fastening means, such as set screw 362.

Lower adapter 356 has an upper end 364 and a tapered lower end 366 with a bore 368 therethrough.

Referring to FIGS. 1I and 1J, it will be seen that an annular volume 370 is defined between bore 212 in J-slot case 214 and outer surface 342 of ball valve cage 336. A biasing means, such as spring 372, is disposed in annular volume 370. Spring 372 bears against lower end 354 of operating mandrel cap 346 and upper end 364 of lower adapter 356.

Operation Of The Packer

Packer 10 is run into the well bore on releasing tool 12 and is initially in the general configuration shown in FIGS. 1A–1J.

Once the packer is positioned at the desired location, the tubing is pressurized to inflate packer element 168. The pressure is applied to packer annulus 180 in packer element 168 through central opening 373 in packer 10 and aligned inflation ports 160 and 162, as seen in FIG. 1D. The pressure forces packer element 168 radially outwardly to sealingly engage the well bore.

Substantially simultaneously, pressure is applied to the top of J-slot piston 220 through J-slot port 272, as seen in FIG. 1G. Referring also to FIG. 2, ball 228 is initially in the bottom of first leg 234 of J-slot 226. As J-slot piston 220 is moved downwardly by the pressure applied thereto, ball 228 is moved from first leg 234 up through transition portion 238 to the top of second leg 236. It will be seen that this downward movement and partial rotation of J-slot piston 220 occurs when the pressure applied thereto is sufficient to exceed the force exerted by spring 300.

Also occurring substantially simultaneously, pressure is applied to the top of mandrel locking piston 110 through aligned piston ports 82 and 104, as seen in FIG. 1B. Referring to FIGS. 1B and 1C, shear pin 122 will shear when sufficient pressure is applied to piston 110, and spring 142 will be compressed. When piston 110 is moved downwardly a sufficient amount, locking ball 128 will become aligned with recess 118.

At this point, weight is set down on the tubing which causes mandrel means 34 to be moved downwardly with respect to upper adapter means 84. As a component of mandrel means 34, inner mandrel 72 is moved downwardly with respect to packer body 94. It will be seen that ball 128 is thus pushed out of lower groove 124 into recess 118. Also, piston port 82 in inner mandrel 72 is moved downwardly with respect to piston port 104 in packer body 94.

Weight is set down until upper end 68 of slot 66 engages retaining lug 92. See FIG. 1B.

Also as inner mandrel 72 is moved downwardly, inflation port 160 therein is moved downwardly with respect to inflation port 162 in packer mandrel 152. Seals 158 and 164 thus sealingly close inflation port 162 so that pressure is trapped within packer element 168.

Pressure in the tubing then may be relieved. When this occurs, J-slot piston 220 will be moved upwardly by spring 300. This results in ball 228 being moved relatively downwardly through second leg 236, through transition portion 242, and on to the bottom of third leg 240 in J-slot 226.

Also when the pressure is relieved, spring 142 will push piston 110 upwardly. Piston 110 moves upwardly until chamfer 117 contacts locking ball 128.

At this point in the procedure, packer element 168 is presumably sealingly engaged with the well bore. In other words, packer 10 is set. To test the setting of packer 10, pressure is applied to the well annulus or weight is set down on the tool. If the packer element can support sufficient weight, it is set. Assuming the test indicates that packer element 168 is properly set, the remaining steps of the setting operation may be carried out. During these remaining steps, weight is kept set down on the tubing.

The first of these steps is to repressurize the tubing. It will be seen that this will again actuate J-slot piston 220 downwardly. This results in ball 228 being moved up through third leg 240, through transition portion 246 and up into the top of fourth leg 244 of J-slot 226. Pressure is then relieved, and spring 300 again moves J-slot piston 220 upwardly so that ball 228 is moved relatively downwardly through fourth leg 244, through transition portion 250 and into the bottom of fifth leg 248. The tubing is pressurized again to once more actuate J-slot piston 220. When this occurs, ball 228 is moved from fifth leg 248 up through transition portion 250 to the top of sixth leg 252 of J-slot 226. Pressure is again relieved so that spring 300 returns J-slot piston 220 to its original position. In this way, ball 228 is moved from sixth leg 258 through transition portion 250 to the bottom of seventh leg 256 of J-slot 226.

During these two pressurization and relief cycles, piston 110 is not actuated since ports 82 and 84 are no longer aligned, and there is no effect on packer element 168 since ports 160 and 162 are no longer aligned.

After these operations, a final pressurization cycle is carried out. Pressure is once again applied to the tubing to move J-slot piston 220 downwardly. When this occurs, ball 228 is moved from seventh leg 256 through transition portion 262 into long eighth leg 260.

It will thus be seen that J-slot piston 220 is then moved downwardly considerably farther than during the previous pressurization cycles. When this occurs, inner locking dog windows 298 are moved downwardly so that they are aligned with locking dogs 294. Locking dogs 294 are moved radially inwardly by springs 296 so that they contact outer surface 278 of releasing sleeve 274. Locking dogs 294 are then no longer engaged with outer locking dog window 290 in J-slot case 214. Because releasing sleeve 274 is attached to J-slot piston 220, it will be seen that J-slot piston 220 is thus locked by locking dogs 294 with respect to locking dog retainer 286 and ball valve operating mandrel 306 attached to locking dog retainer 286.

Spring 372 moves J-slot operating mandrel upwardly with respect to lower adapter 356, J-slot case 214 and ball valve case 336. Referring to FIG. 1I, it will be seen that operating pin 338 is thus moved upwardly with respect to ball 330 which thereby rotates the ball to an open position. Fluid is thus free to flow through central opening 373 of packer 10.

If packer element 168 is not properly engaged with the well bore during the first pressurization cycle, that is when ball 228 is moved from first leg 234 to second leg 236 of J-slot 226, packer 10 provides two additional opportunities to set the packer element. If packer element 168 does not set properly, weight is picked up on the tubing, this moves inner mandrel 72 of mandrel means 34 back to its original position as shown in FIGS. 1B–1D. Thus, packer inflation ports 160 and 162 are realigned, and piston ports 82 and 104 are realigned. At this point, the entire operation, except for J-slot positioning, may be carried out again. That is, pressure may again be applied to inflate packer element 168. If packer element 168 properly engages this time, then weight is again set down. It will be seen that two additional pressurization cycles will move ball 228 into long eighth leg 260 of J-slot 226 so that the ball valve is opened.

If packer element 168 does not set properly the second time, weight may once again be picked up to provide a third opportunity to inflate the packer element. Assuming that packer element 168 properly inflates the third time, weight is again set down, and it will be seen that one additional pressurization cycle will move ball 228 into long leg 260 of J-slot 226 to open the ball valve.

To remove packer 10 from the well bore, weight is simply picked up to raise mandrel means 34. When this occurs, packer inflation ports 160 and 162 are realigned, as mentioned, so that the pressure in packer element 168 is relieved. Once packer element 168 is deflated, releasing tool 12 and packer 10 may be removed from the well bore.

As inner mandrel 72 of mandrel means 34 is raised, ball 128 is pushed out of upper groove 80 into recess 118 and piston 110. Because upper groove 80 is relatively shallow, ball 128 will move out of it relatively easily. As inner mandrel 72 is moved further upwardly, ball 128 will become aligned with deeper lower groove 124. When this occurs, piston 110 will bear against ball 128 and force it into lower groove 124, and piston 110 will then be free to move back to its initial position shown in FIGS. 1B and 1C.

If it is desired or necessary to leave packer 10 in the well bore for any purpose, a latch-in plug 374 may be pumped down the tubing. See FIG. 1A. At the top of latch-in plug 374 is an upper adapter 376 having a longitudinal hole 378 therein in communication with a transverse port 380. A downwardly facing chamfered shoulder 382 on upper adapter 376 is adapted for contacting chamfer 45 in the upper end of releasing sleeve 40.

Upper adapter 376 has an outer surface 384 which fits closely within bore 44 in releasing sleeve 40. A sealing means, such as a pair of seals 386, provide sealing engagement between upper adapter 376 and releasing sleeve 40 when latch-in plug 374 is in the position shown in FIG. 1A.

Upper adapter 376 defines a locking ring groove 388 therein which is generally alignable with locking ring groove 46 in releasing sleeve 40. A locking ring 390 is positioned in groove 388 and is inherently biased radially outwardly. Locking ring 390 has a downwardly facing chamfer 392 therein.

The lower end of upper adapter 376 is attached to upper connector 394 at threaded connection 396. Upper connector 398 is connected to flexible connector 398. Flexible connector 398, in turn, is connected to a lower connector 400. Flexible connector 398 is preferably made of a resilient material and is attached to upper and lower connectors 394 and 400 by any means known in the art, such as by adhesive, heat bonding, etc.

The lower end of lower connector 400 is attached to a lower adapter 402 at threaded connection 404. Lower adapter 402 defines an annular outer recess 406 thereon, and a resilient wiper ring 408 is disposed in recess 406. Wiper ring 408 has a plurality of generally outwardly extending lips 410 thereon which are adapted for wiping engagement with the inside of the tubing string and bore 44 in releasing sleeve 40.

As latch-in plug 374 enters releasing sleeve 40 in packer 10, locking ring 390 is deflected radially inwardly as chamfer 392 therein engages chamfer 45 in releasing sleeve 40. When locking ring groove 388 in upper adapter 376 of latch-in plug 374 is aligned with locking ring groove 46 in releasing sleeve 40, locking ring 90 will snap radially outwardly to engage groove 46, thereby locking latch-in plug 374 in position in releasing sleeve 40. The contact of chamfered surface 382 on upper adapter 376 with chamfer 45 in releasing sleeve 40, provides a stop for latch-in plug 374.

As latch-in plug 374 is pumped downward through the tubing string, flexible connector 398 compensates for irregularities and curvatures in the tubing string so that the latch-in plug does not become jammed therein. Lips 410 on wiper ring 48 insure that latch-in plug 374 is substantially sealingly engaged with the inside of the tubing string so that pressure applied thereto will easily force it downwardly toward packer 10.

When latch-in plug 374 reaches the operating position shown in FIG. IA, additional pressure applied to the tubing string will cause the latch-in plug to move releasing sleeve downwardly, thereby shearing shear pin 42. As releasing sleeve 40 is moved downwardly, locking dog groove 48 on the releasing sleeve is brought into alignment with locking dog openings 56 in retrieving head 36. At this point, springs 60 move locking dogs 58 radially inwardly to engage locking dog groove 48. Thus, locking dogs 58 are no longer engaged with overshot retainer 24. Releasing tool 12 may then be raised upwardly out of the well bore leaving packer 10 and latch-in plug 374 in position.

Ordinarily, packer 10 is only left in the well bore in an emergency situation, such as when the packer becomes stuck. Because the coiled tubing may not have sufficient tensile strength to remove the packer in this situation, it is necessary to release it using the above-described releasing means. However, there may be a situation where it is desirable to leave packer 10 in the well bore and close off central opening 373 therethrough with latch-in plug 374 so that packer 10 effectively acts as a bridge plug. When it is not necessary to sealingly close central opening 374 through packer 10 when it is being released, a release ball 412 may be dropped through the tubing to engage chamfer 45 on releasing mandrel 40. When using release ball 412 rather than latch-in plug 374, the release of packer 10 is substantially similar to the release of the bridge plug of the present invention which is further described herein.

After being left in the well bore, packer 10 may be retrieved by lowering a conventional retrieving tool into the well bore to engage retrieving head 36 which is configured as a standard retrieving neck. An upward pull on retrieving head 36 will release packer 10 in the same manner as previously described. Packer 10, along with latch-in plug 374 or release ball 412 therein may then be removed from the well bore as desired.

Bridge Plug

Referring now to FIGS. 3A–3G, the coil tubing set inflatable bridge plug of the present invention is shown and generally designated by the numeral 420. At the upper end of bridge plug 420 is the same releasing tool 12 which has been previously described with respect to packer 10. Releasing tool 12 is used to run bridge plug 420 into a well bore and is also used to leave the bridge plug down hole when desired.

Figure 3A:
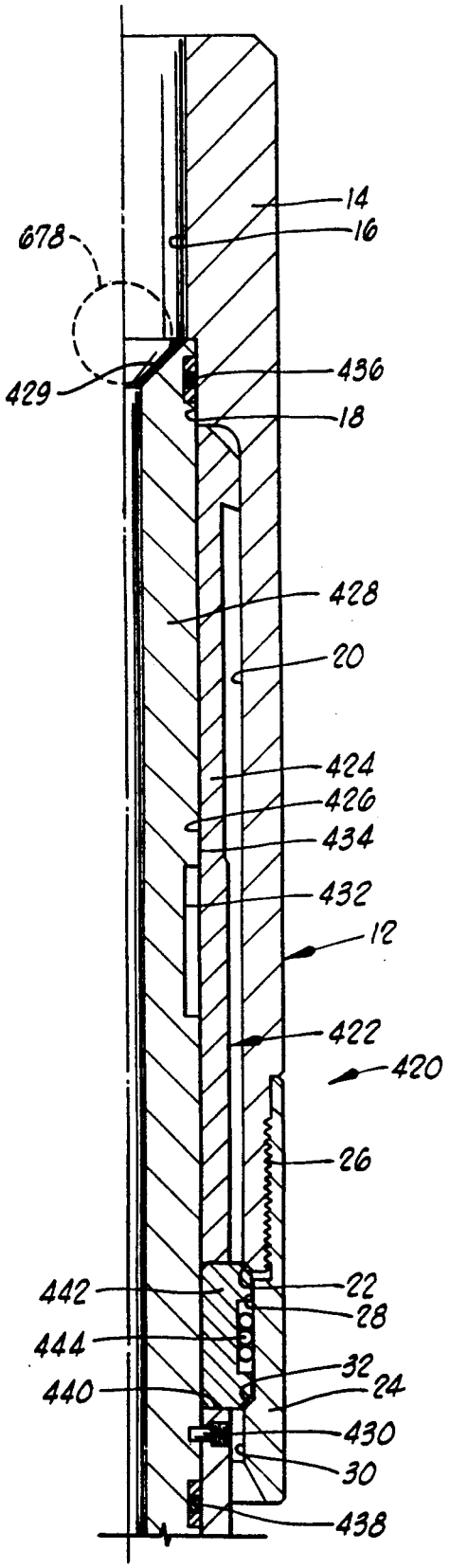
FIGS. 3A–3G show a longitudinal cross section of the coil tubing set inflatable bridge plug of the present invention.

As previously described, and as shown again in FIG. 3A, releasing tool 12 comprises an overshot 14 which is connected at its upper end to a coiled tubing unit in a manner known in the art. Overshot 14 has a first bore 16, second bore 18 and third bore 20 defined therein which are progressively larger. At the lower end of overshot 14 is an internal chamfered shoulder 22.

The lower end of overshot 14 is attached to an overshot retainer 24 in threaded connection 26. Overshot retainer 24 has a first bore 28 and a slightly smaller second bore 30 therein. A chamfered shoulder 32 interconnects first and second bores 28 and 30.

Releasing tool 12 is disposed around the upper end of a mandrel means 422. This upper end of mandrel means 422 is preferably characterized by a retrieving head 424 which has a first bore 426 therein. It will be seen that first bore 426 in retrieving head 424 and second bore 18 in overshot 14 are substantially the same size and aligned with one another.

Disposed in second bore 18 of overshot 14 and first bore 426 of retrieving head 424 is a releasing mandrel 428. Releasing mandrel 428 has a chamfer 429 at the upper end thereof. Releasing mandrel 428 is slidably disposed in overshot 14 and retrieving head 424 and is initially held in the position shown by a shear pin 430. A locking dog groove 432 is defined in outer surface 434 of releasing mandrel 428.

Sealing engagement is provided between overshot 14 and the upper end of releasing mandrel 428 by an upper sealing means, such as seal 436. Similarly, sealing engagement is provided between retrieving head 424 and the lower end of releasing mandrel 428 by a lower sealing means, such as seal 438.

Defined transversely through retrieving head 424 are a plurality of locking dog openings 440 which are circumferentially spaced around the retrieving head. A locking dog 442 is disposed in each locking dog opening 440. Each locking dog 442 is biased against outer surface 434 of releasing mandrel 428 by a biasing means, such as spring 444. It will be seen that locking dogs 442 are positioned longitudinally between, and retained by, shoulder 22 on overshot 14 and shoulder 32 in overshot retainer 24.

Figure 3B:
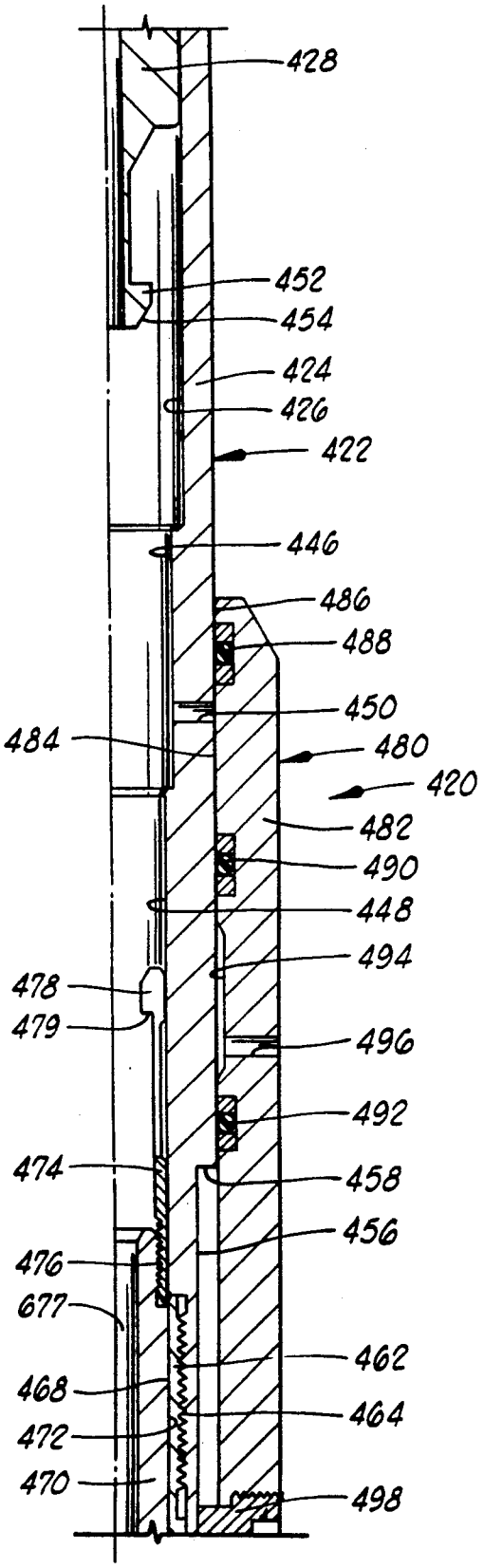

Referring now to FIG. 3B, retrieving head 424 has a smaller second bore 446 and an even smaller third bore 448 therein. A transverse bypass port 450 is defined through retrieving head 424 and is in communication with second bore 446.

Figure 3C:
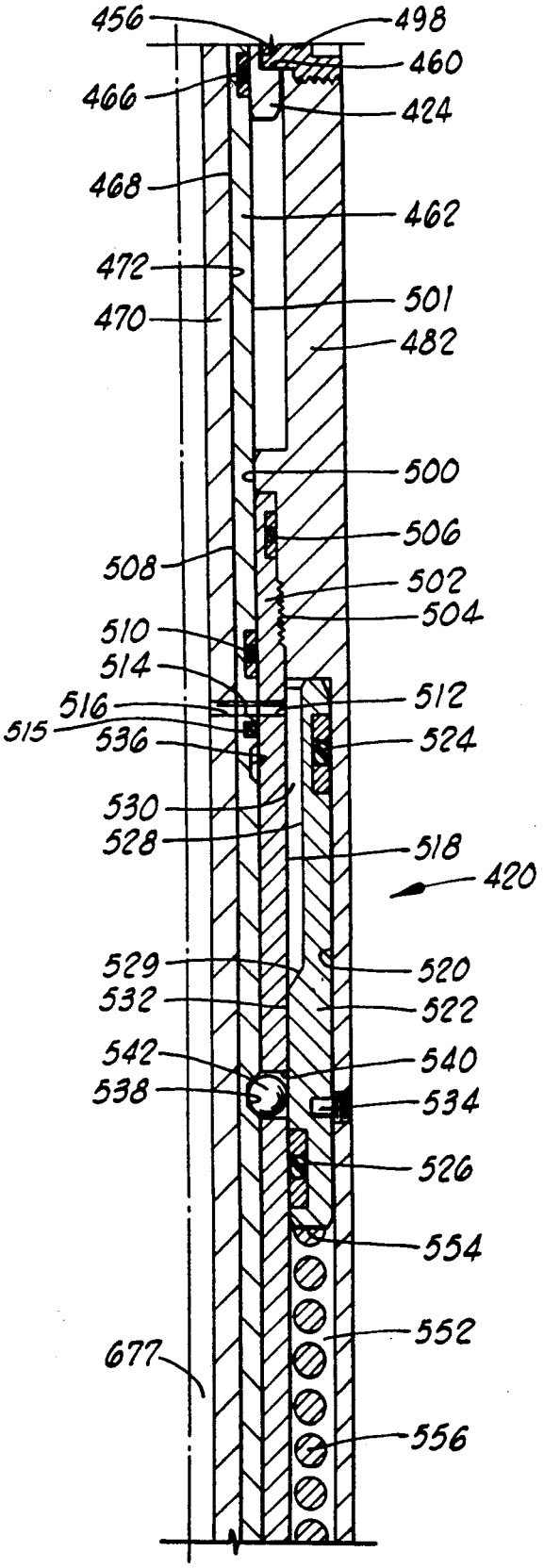

At the lower end of releasing mandrel 428 is a radially outwardly extending collet engaging flange 452 having a downwardly facing chamfer 454 thereon. Referring now to FIGS. 3B and 3C, the lower end of retrieving head 424 defines a longitudinally extending slot 456 having an upper end 458 and a lower end 460.

The lower end of retrieving head 424 is attached to a central mandrel 462 at threaded connection 464. A sealing means, such as seal 466, provides sealing engagement between retrieving head 424 and central mandrel 462.

Central mandrel 462 defines a bore 468 therein which is substantially the same size as third bore 448 in retrieving head 424. An inner mandrel 470 is disposed in central mandrel 462. An outer surface 472 of inner mandrel 470 is adapted for close, sliding engagement with bore 468 in central mandrel 462.

Referring to FIG. 3B, the upper end of inner mandrel 470 is attached to a collet 474 at threaded connection 476. Collet 474 has a plurality of collet fingers 478 which extend upwardly therefrom. Each collet finger 478 has a lower lip 479 thereon. In the initial position shown in FIG. 3B, it will be seen that collet fingers 478 substantially engage bore 448 in retrieving head 424 and thus are prevented from radially outward movement.

Still referring to FIG. 3B, disposed around mandrel means 422 is an adapter means 480. At the upper end of adapter means 480 is an upper adapter 482 having a first bore 484 therein. First bore 484 is adapted for slidingly receiving a lower portion of retrieving head 424.

A sealing means provides sealing engagement between first bore 484 in upper adapter 482 and outer surface 486 of retrieving head 424. Preferably, the sealing means comprises an upper seal 488, a middle seal 490 and a lower seal 492. It will be seen that upper seal 488 and middle seal 490 are initially on opposite sides of port 450 in retrieving head 424.

Between middle seal 490 and lower seal 492, upper adapter 482 defines an annular recess 494 therein. A transverse bypass port 496 provides communication between recess 494 and the well annulus.

A retaining lug 498 is attached to upper adapter 482 and extends into slot 456 in retrieving head 424. It will be seen by those skilled in the art that longitudinal movement between mandrel means 422 and adapter means 480 is possible, while relative rotation therebetween is prevented.

Referring now to FIG. 3C, upper adapter 482 also defines a second bore 500 therethrough which is adapted for slidingly receiving outer surface 501 of central mandrel 462.

Below second bore 500, upper adapter 482 is attached to a packer body 502 at threaded connection 504. A sealing means, such as seal 506, provides sealing engagement between upper adapter 482 and packer body 502.

Packer body 502 has a bore 508 in which outer surface 501 of central mandrel 462 is slidably disposed. A sealing means, such as seals 510 and 511, provides sliding, sealing engagement between central mandrel 462 and packer body 502.

Packer body 502 defines a transverse piston port 512 therethrough which is initially aligned with a transverse port piston 514 in central mandrel 462 and another transverse piston port 516 in inner mandrel 470. Seals 510 and 511 are on opposite sides of piston port 514.

Packer body 502 has a first outer surface 518, and upper adapter 482 has a third bore 520 therein which is spaced radially outwardly from outer surface 518 such that an annular volume is defined therebetween. Slidably disposed in this annular volume is a mandrel locking piston 522. Sealing engagement is provided between piston 522 and third bore 520 in upper adapter 482 by an upper sealing means, such as seal 524. Similarly, sealing engagement is provided between piston 522 and first outer surface 518 of packer body 502 by a lower sealing means, such as seal 526.

Piston 522 has a first bore 528 therein with a chamfer 529 at the lower end thereof. First bore 528 is spaced radially outwardly from outer surface 518 of packer body 502 such that an annular recess 530 is defined therebetween. Piston 522 also has a smaller second bore 532 therethrough which is adapted for close, sliding relationship with outer surface 518 of packer body 502.

Piston 522 is initially locked with respect to upper adapter 482 by a shear pin 534.

Outer surface 501 of central mandrel 462 defines a shallow annular upper groove 536 and further defines a deeper lower groove 538 therein which is spaced below upper groove 536.

Packer body 502 defines a transverse hole 540 therein which is initially aligned with lower groove 538 in central mandrel 462. A locking ball 542 is positioned in hole 540 and extends into lower groove 538. Radially outward movement of ball 542 is prevented by second bore 532 in piston 522. Thus, it will be seen by those skilled in the art that when ball 542 is in this position, relative longitudinal movement between central mandrel 462 and packer body 502 is prevented.

Figure 3D:
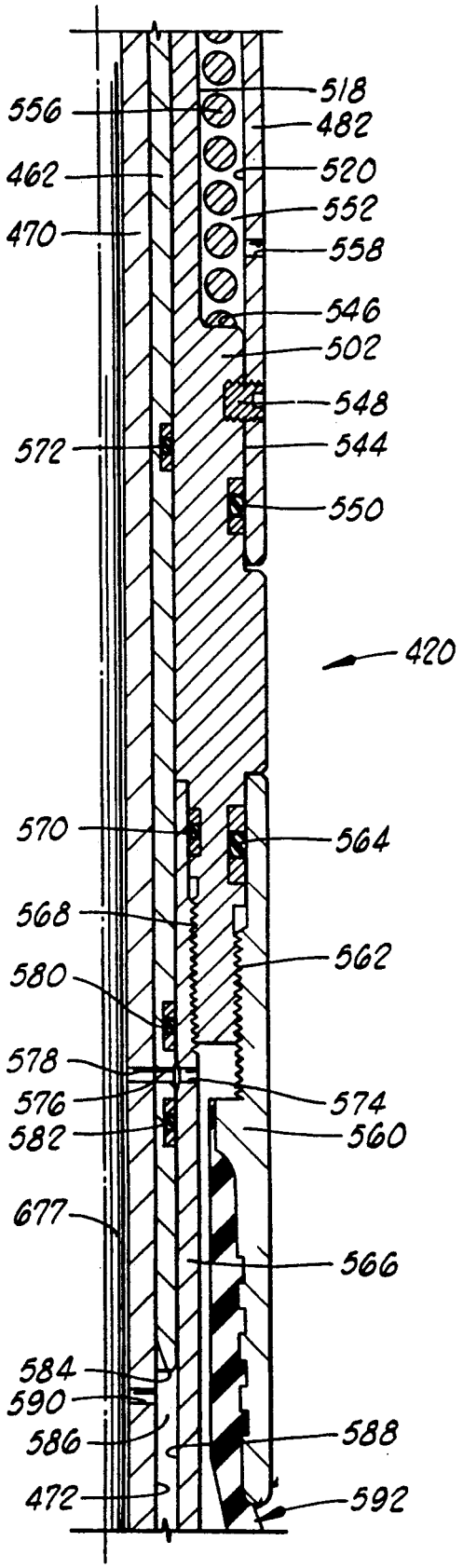

Referring now to FIG. 3D, packer body 502 has a second outer surface 544 thereon which fits closely within third bore 520 in upper adapter 482. An annular shoulder 546 extends between first outer surface 518 and second outer surface 544 of packer body 502.

The lower end of upper adapter 482 is attached to packer body 502 by a set screw 548. A sealing means, such as seal 550, provides sealing engagement between upper adapter 582 and packer body 502.

As seen in FIGS. 3C and 3D, an annular volume 552 is defined radially between first outer surface 518 of packer body 502 and third bore 520 in upper adapter 482 and longitudinally between shoulder 546 on the packer body and lower end 554 of piston 522. A biasing means, such as spring 556, is disposed in annular volume 552. Spring 556 bears on shoulder 546 and lower end 554 for biasing piston 522 in an upward direction.

Referring again to FIG. 3D, upper adapter 482 defines a substantially transverse port 558 therethrough which provides communication between annular volume 552 and the well annulus.

The lower end of packer body 502 is attached on its outer side to an upper packer coupling 560 at threaded connection 562. A sealing means, such as seal 564, provides sealing engagement between packer body 502 and upper packer coupling 560.

The lower end of packer body 502 is attached on its inside to a packer mandrel 566 at threaded connection 568. A sealing means, such as seal 570, provides sealing engagement between packer body 502 and packer mandrel 566.

Another sealing means, such as seal 572, provides sealing engagement between central mandrel 462 and packer body 502. Referring back to FIG. 3C, it will be seen that seal 572 is below ball 542.

Still referring to FIG. 3D, packer mandrel 566 defines a transverse inflation port 574 therethrough which is initially aligned with another transverse inflation port 576 defined through central mandrel 562 and inflation port 578 defined through inner mandrel 470.

A sealing means, such as seal 580, provides sealing engagement between central mandrel 462 and packer mandrel 566 above inflation ports 574 and 576. Another sealing means, such as seal 582, provides sealing engagement between central mandrel 462 and packer mandrel 566 below ports 574 and 576.

Central mandrel 462 has a lower end 584, and it will be seen that an annular volume 586 is thus defined between outer surface 472 of inner mandrel 470 and a bore 588 through packer mandrel 566 and below lower end 584 of central mandrel 462.

Inner mandrel 470 defines a substantially transverse deflation port 590 therein which is initially in communication with annular volume 586.

The upper end of an inflatable packer element 592 is connected to upper packer coupling 560 in a manner known in the art. Packer element 592 itself is of a kind generally known in the art.

A packer annulus 604 is defined between packer mandrel 566 and packer element 592. Packer annulus 604 is in communication with inflation port 574 in packer mandrel 566.

Figure 3E:
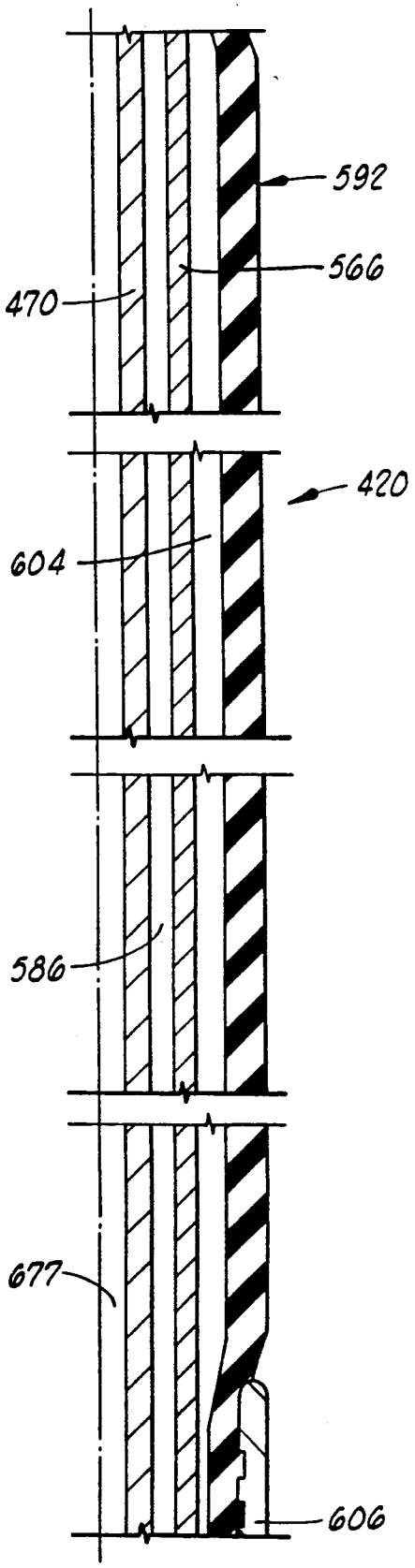
Figure 3F:
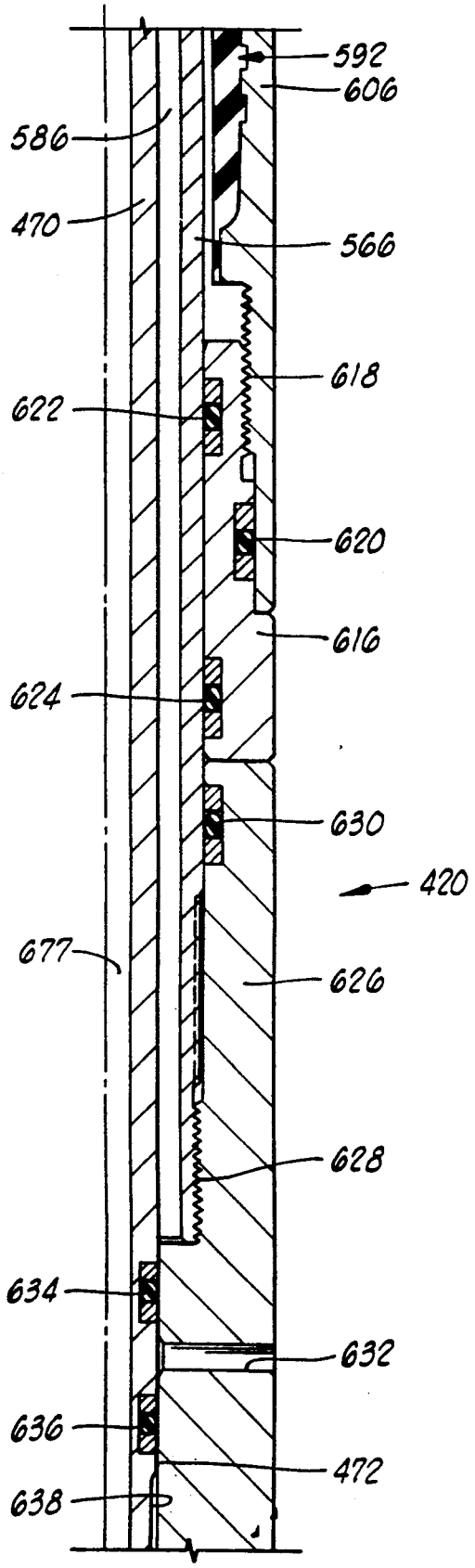

Referring now to FIGS. 3E and 3F, the lower end of packer element 592 is attached to a lower packer coupling 606 which may be substantially identical to upper packer coupling 560.

Referring to FIG. 3F, the lower end of lower packer coupling 606 is attached to a floating shoe 616 at threaded connection 618. A sealing means, such as seal 620, provides sealing engagement between lower packer coupling 606 and floating shoe 616.

A sealing means, such as seals 622 and 624, provide sealing engagement between packer mandrel 566 and floating shoe 616.

The lower end of packer mandrel 566 is attached to center coupling 626 at threaded connection 628 Sealing engagement is provided between packer mandrel 566 and center coupling 626 by a sealing means, such as seal 630. It will be seen that the upper end of center coupling 626 is adjacent to the lower end of floating shoe 616.

Center coupling 626 defines a substantially transverse bypass port 632 therethrough. An upper sealing means, such as upper seal 634, and a lower sealing means, such as lower seal 636, provide sealing engagement between inner mandrel 470 and center coupling 626 on opposite sides of bypass port 632 when in the initial position shown in FIG. 3F.

Figure 3G:
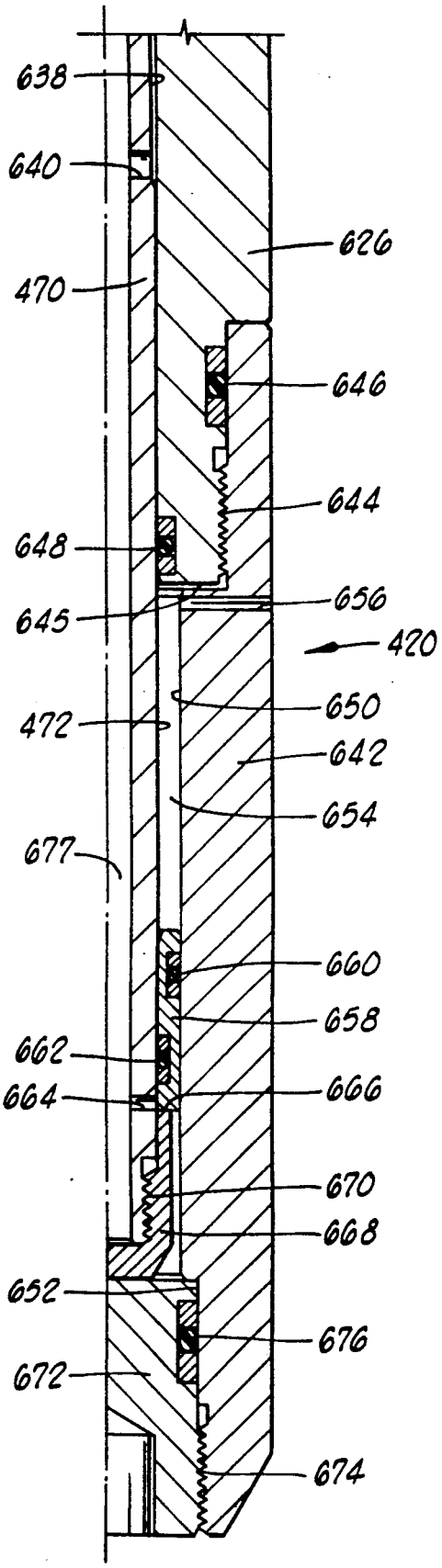

As seen in FIGS. 3F and 3G, below lower seal 636, outer surface 472 of inner mandrel 470 defines an annular recess 638 therein. Inner mandrel 470 defines a substantially transverse bypass port 640 therethrough which is in communication with recess 638, as seen in FIG. 3G.

Still referring to FIG. 3G, the lower portion of center coupling 626 is attached to a lower adapter 642 at threaded connection 644. Center coupling 626 has a lower end 645. A sealing means, such as seal 646, provides sealing engagement between center coupling 626 and lower adapter 642.

Another sealing means, such as seal 648, provides sealing engagement between center coupling 626 and inner mandrel 470 below bypass port 640.

Lower adapter 642 defines a first bore 650 and a slightly larger second bore 652 therethrough. First bore 650 is spaced radially outwardly from outer surface 472 of inner mandrel 470 such that an annular volume 654 is defined therebetween. A transverse equalizing port 656 is defined through lower adapter 642 at the upper end of annular volume 654 such that communication is provided between the annular volume and the well annulus.

Slidably disposed in annular volume 654 is a pressure equalizing piston 658. A sealing means, such as seal 660 provides sealing engagement between piston 658 and first bore 650 in lower adapter 642, and another sealing means, such as seal 662, provides sealing engagement between the piston and inner mandrel 470. Below seal 662, inner mandrel 470 defines a transverse equalizing port 664 therethrough which is thus in communication with annular volume 654 below piston 658.

Downward movement of piston 658 is limited by upper end 666 of a mandrel cap 668. Mandrel cap 668 is attached to the lower end of inner mandrel 470 at threaded connection 670 and closes off the lower end of the inner mandrel.

The lower end of lower adapter 642 is closed by an adapter plug 672 attached to the lower adapter at threaded connection 674. A portion of adapter plug 674 extends into second bore 652 in lower adapter 642, and a sealing means, such as seal 676, provides sealing engagement therebetween.

Operation Of The Bridge Plug

Bridge plug 420 is run into the well bore on releasing tool 12 and is initially in the general configuration shown in FIGS. 3A-3G.

Once bridge plug 420 is positioned at the desired location, the tubing is pressurized to inflate packer element 592. Pressure is applied to packer annulus 604 in packer element 592 through central opening 677 in bridge plug 420 and aligned inflation ports 574, 576 and 578, as seen in FIG. 3D, and the pressure forces packer element 592 radially outwardly to sealingly engage the well bore.

Substantially simultaneously, pressure is applied to the top of mandrel locking piston 522 through aligned ports 512, 514 and 516, as seen in FIG. 3C. Shear pin 534 will shear when sufficient pressure is applied to piston 522, and spring 556 will be compressed. When piston 522 is moved downwardly a sufficient amount, locking ball 542 will become aligned with recess 530.

At this point, weight is set down on the tubing which causes mandrel means 422 to be moved downwardly with respect to upper adapter means 480. As a component of mandrel means 422, center mandrel 462 is moved downwardly with respect to packer body 502. It will be seen that ball 542 is pushed out of lower groove 538 into recess 530. Also, piston port 514 in center mandrel 462 is moved downwardly with respect to piston port 512 in packer body 502 and piston port 516 in inner mandrel 470.

Weight is set down until upper end 458 of slot 456 engages retaining lug 498. See FIG. 3B.

Also as center mandrel 462 is moved downwardly, inflation port 576 therein is moved downwardly with respect to inflation port 574 in packer mandrel 566 and inflation port 578 in inner mandrel 470. Preferably, center mandrel 462 is moved downwardly an amount sufficient for port 576 therein to become aligned with deflation port 590 in inner mandrel 470. Seals 572 and 580 thus sealingly close inflation port 574 so that pressure is trapped within packer element 592.

Also occurring substantially simultaneously during pressurization, equalizing piston 658 may be moved upwardly in annular volume 654. Upward movement is limited by lower end 645 of center coupling 626. See FIG. 3G.

At this point, pressure in the tubing may be relieved. When this occurs, spring 556 will push piston 522 upwardly until chamfer 529 contacts locking ball 542. This will cause ball 542 to be forced into upper groove 536 which is now substantially aligned with hole 540 in packer body 502. Thus, center mandrel 462 is again locked with respect to packer body 502.

Another result of mandrel means 422 being moved downwardly is that retrieving head 424 is moved downwardly with respect to upper adapter 482. When this occurs, bypass port 450 in retrieving head 424 is substantially aligned with bypass port 496 in upper adapter 482. Also, second bore 446 of retrieving head 424 is aligned with collet fingers 478 of collet 474 such that the collet fingers may be flexed radially outwardly.

When it is desired to leave bridge plug 420 in the well bore, a releasing ball 678 is pumped down the tubing. See FIG. 3A. Releasing ball 678 will contact chamfer 429 in releasing mandrel 428. Additional pressure applied to the tubing string will cause releasing ball 678 to move releasing mandrel 428 downwardly, thereby shearing shear pin 430. As releasing mandrel 428 is moved downwardly, locking dog groove 432 on the releasing mandrel is brought into alignment with locking dog openings 440 in retrieving head 424. At this point, springs 444 move locking dogs 442 radially inwardly to engage locking dog groove 432. Thus, locking dogs 442 are no longer engaged with overshot retainer 24. Releasing tool 12 may then be raised upwardly out of the well bore leaving bridge plug 420 in position.

When releasing mandrel 428 is moved downwardly as described, chamfer 454 on flange 452 at the lower end thereof engages collet fingers 478, causing them to flex radially outwardly, flange 452 is moved below lips 479 on collet fingers 478, so the collet fingers will snap back radially inwardly. It will be seen by those skilled in the art that flange 452 on releasing mandrel 428 is thus engaged with collet fingers 478.

When it is desired to remove bridge plug 420 from the well bore, a retrieving tool of a kind known in the art is lowered into the well bore and engaged with retrieving head 424. This retrieving tool is used to apply a lifting force to retrieving head 424. When this occurs, retrieving head 424 is raised with respect to upper adapter 482. However, bypass port 450 therein is still aligned with recess 494 so that bypass port 450 in the retrieving head and bypass port 496 in the upper adapter remain in fluid communication.

Because of the engagement of locking dogs 442 with locking dog 432, lifting on retrieving head 424 will also raise releasing mandrel 428. Because flange 452 on releasing mandrel 428 is engaged with collet fingers 478 of collet 474, inner mandrel 470 is also raised because collet 474 is attached to inner mandrel 470.

Inner mandrel 470 is raised enough so that recess 638 therein is brought into alignment with bypass port 632 in center coupling 626. See FIG. 3F. A fluid passageway is thus defined through bypass port 496 and recess 494 in upper adapter 482, bypass port 450 in retrieving head 424, central opening 677 through packer 420, bypass port 640 and recess 638 in inner mandrel 470 and bypass port 632 in center coupling 626. It will be seen by those skilled in the art that this passageway flows from above to below packer element 592 or in the opposite direction. Thus, a bypass means is provided around sealed packer element 592.

By raising further on retrieving head 424, center mandrel 462 is lifted as well. Ball 542 is then pushed out of upper groove 536 into recess 530 in piston 522. Because upper groove 536 is relatively shallow, ball 542 will move out of it relatively easily. As center mandrel 462 is raised further, ball 542 will be again aligned with lower groove 538. Piston 522 will force ball 542 into lower groove 538, thus freeing the piston to return to its initial position shown in FIG. 3C.

Center mandrel 462 is raised with inner mandrel 470 until port 576 in center mandrel 462, which is aligned with deflation port 590 in the inner mandrel as previously described, are brought into alignment with port 574 in packer mandrel 566. In this way, the pressure in packer element 592 is relieved. Once packer element 592 is deflated, the retrieving tool and packer 420 may be removed from the well bore.

It will be seen, therefore, that the coiled tubing set inflatable packer of the present invention, the bridge plug embodiment thereof, and the releasing tool therefor are well adapted to carry out the ends and advantages mentioned as well as those inherent therein. While presently preferred embodiments of the apparatus have been shown for the purposes of this disclosure, numerous changes in the arrangement and construction of parts may be made by those skilled in the art. All such changes are encompassed within the scope and spirit of the appended claims.

What is claimed is:

1. A downhole inflatable packing apparatus comprising:

an adaptor means for defining in inflation port therein;

mandrel means for sliding within said adaptor means and defining an inflation port therein aligned with said inflation port on said adaptor means when in an inflation position, said mandrel means being movable to a sealed position when weight is applied thereto wherein said inflation port in said mandrel means is unaligned with said inflation port in said adaptor means;

an inflatable packer element attached to said adaptor means and adapted for inflation by fluid pumped through the aligned inflation ports when said mandrel means is in said inflation position; and pressure actuated releasing and locking means for releasing said mandrel means from said inflation position, thereby allowing movement of said mandrel means to said sealed position and for locking said mandrel means in said sealed position, wherein said pressure actuated releasing and locking means is moveable back to its initial position for releasing said mandrel means from said sealed position, thereby allowing movement of said mandrel means back to said inflation position and locking said mandrel means in said inflation position.

2. The apparatus of claim 1 further comprising means for limiting movement of said mandrel means with respect to said adapter means.

3. A downhole inflatable packing apparatus comprising:

an adaptor means for defining an inflation port therein;

mandrel means for sliding within said adaptor means and defining an inflation port therein aligned with said inflation port on said adaptor means when in an inflation position, said mandrel means defining a pair of grooves thereon and being movable to a sealed position when weight is applied thereto wherein said inflation port in said mandrel means is unaligned with said inflation port in said adaptor means;

an inflatable packer element attached to said adaptor means and adapted for inflation by fluid pumped through the aligned inflation ports when said mandrel means is in said inflation position; and pressure actuated releasing and locking means for releasing said mandrel means from said inflation position, whereby allowing movement of said mandrel means to said sealed position and for locking said mandrel means in said sealed position, said releasing and locking means being characterized by:

a piston slidably disposed in said adaptor means;

biasing means for biasing said piston toward an initial position thereof with respect to said adaptor means; and a locking ball engaged by said piston and held thereby in one of said grooves for locking said mandrel means in said inflation position;

wherein:

when pressure is applied to said piston, said piston is moved toward said biasing means such that said ball is freed from said one groove and said mandrel means is freed for movement to said sealed position wherein said ball is aligned with the other groove; and when pressure is relieved from said piston, said biasing means moves said piston toward said initial position such that said ball is held in said other groove for locking said mandrel means in said sealed position.

4. The apparatus of claim 3 further comprising shearing means for shearably holding said piston in said initial position.

5. The apparatus of claim 3 wherein:

said adapter means defines an annular volume therein; and said piston and biasing means are disposed in said annular volume.

6. The apparatus of claim 5 wherein said adapter means defines a hole therethrough for providing communication between said annular volume and a well annulus.

7. The apparatus of claim 5 wherein said adapter means defines an opening therethrough adjacent to said piston in which said ball is at least partially disposed.

8. The apparatus of claim 7 wherein:

said adapter means defines a piston port therein in communication with said annular volume; and said mandrel means defines a piston port therein aligned with said piston port in said adapter means when said mandrel means is in said inflation position.

9. The apparatus of claim 3 further comprising sealing means between said piston and said adapter means.

10. The apparatus of claim 3 wherein said one groove is deeper than said other groove.

11. An inflatable packer comprising:

adapter means for defining an inflation port therein;

mandrel means for sliding within said adapter means and defining an inflation port therein aligned with said inflation port in said adapter means when in an inflation position, said mandrel means being movable during an inflation cycle to a sealed position when weight is applied thereto wherein said inflation port in said mandrel means is unaligned with said inflation port in said adapter means;

an inflatable packer element attached to said adapter means and adapted for inflation during said inflation cycle by fluid pumped through the aligned inflation ports when said mandrel means is in said inflation position;

valve means below said packer element for opening a central passage through the packer when actuated; and pressure responsive J-slot means for allowing a plurality of said inflation cycles and allowing actuation of said valve means after said plurality of said inflation cycles.

12. The apparatus of claim 11 wherein said J-slot means comprises:

a J-slot case attached to said packer element;

a J-slot piston slidably disposed in said J-slot case, one of said J-slot case and said J-slot piston defining a J-slot thereon; and a J-slot ball retained by the other of said J-slot case and said J-slot piston, said ball engaging said J-slot.

13. The apparatus of claim 12 wherein said J-slot has a plurality of legs corresponding to said plurality of said inflation cycles and a relatively longer leg corresponding to a position allowing actuation of said valve means.

14. The apparatus of claim 12 wherein said J-slot means further comprises biasing means for biasing said J-slot piston toward said packer element.

15. The apparatus of claim 12 wherein:

said J-slot case and said mandrel means define an annular volume therebetween; and said J-slot piston is positioned in said annular volume.

16. The apparatus of claim 15 wherein said mandrel means defines a pressure port therethrough for providing communication between said annular volume and a central opening through the packer.

17. The apparatus of claim 15 wherein said J-slot case defines a port therein for providing communication between said annular volume and a well annulus.

18. The apparatus of claim 11 wherein:

said valve means comprises operating mandrel means for actuating said valve means to an open position thereof;

said J-slot means comprises:

a J-slot case initially locked with respect to said operating mandrel means;

a J-slot piston slidably disposed in said J-slot case; and releasing means for releasing said operating mandrel means from said J-slot case; and further comprising biasing means for biasing said operating mandrel means to said open position when released from said J-slot case.

19. The apparatus of claim 18 further comprising:

a J-slot mandrel extending from said J-slot piston and defining a substantially transverse mandrel opening therethrough;

said J-slot case defining a substantially transverse case opening therethrough initially longitudinally spaced from said mandrel opening;

said operating mandrel means comprising a retainer defining a retainer opening therethrough initially aligned with said case opening; and inwardly biased locking dog means initially disposed in said case opening and said retainer opening and biased toward said J-slot mandrel;

wherein, after sufficient movement of said J-slot piston with respect to said J-slot case, said mandrel opening is aligned with said retainer opening such that said locking dog means moves inwardly for engaging said mandrel opening and disengaging from said case opening, thereby releasing said operating mandrel means with respect to said J-slot case.

20. The apparatus of claim 19 wherein said locking dog means comprises a spring biased locking dog.

21. The apparatus of claim 18 wherein said biasing means is characterized by a spring.

22. The apparatus of claim 11 wherein said valve means comprises a ball valve.

23. An inflatable bridge plug apparatus comprising:

adapter means for defining an inflation port and upper and lower bypass ports therein;

mandrel means for sliding in said adapter means and defining an inflation port therein aligned with said inflation port in said adapter means when in an inflation position, said mandrel means being movable to a sealed position wherein said inflation port in said mandrel means is unaligned with said inflation port in said adapter means, said mandrel means further defining an upper bypass port therein and being further movable to a bypass position wherein said upper bypass port in said mandrel means is aligned with said upper bypass port in said adapter means;

bypass means for sliding in said adapter means and defining an inflation port therein aligned with said inflation ports in said mandrel means and adapter means when in an inflation position, said bypass means also defining a deflation port therein alignable with said inflation port in said mandrel means when said mandrel means is in said sealed position, said bypass means further defining a lower bypass port therein aligned with said lower bypass port in said adapter means when in said bypass position; and an inflatable packer element attached to said adapter means and adapted for inflation by fluid pumped through the aligned inflation ports when said mandrel means and said bypass means are in said inflation positions thereof.

24. The apparatus of claim 23 further comprising a collet extending from said bypass means; and a releasing mandrel disposed in said mandrel means for engaging said collet when said mandrel means is in said sealed position, such that a subsequent lifting force applied to said mandrel means after said engagement will move said mandrel means and said bypass means to said bypass positions thereof.

25. The apparatus of claim 24 further comprising a releasing ball for engaging said releasing mandrel and moving said releasing mandrel into engagement with said collet when pressure is applied above said releasing mandrel and releasing ball.

26. The apparatus of claim 24 further comprising locking means for locking said releasing mandrel with respect to said mandrel means after said releasing mandrel is engaged with said collet.

27. The apparatus of claim 23 further comprising equalizing means for equalizing pressure in said bypass means with pressure in a well annulus.

28. The apparatus of claim 27 wherein said equalizing means comprises said adapter means and bypass means defining an annular volume therebetween;

said adapter means defining an equalizing port therethrough adjacent to a longitudinal end of said annular volume for providing communication between said annular volume and said well annulus;

said bypass means defining an equalizing port therethrough adjacent to an opposite longitudinal end of said annular volume for providing communication between said annular volume and a central opening through the bridge plug; and an equalizing piston slidably disposed in said annular volume between said equalizing ports.

29. The apparatus of claim 28 further comprising means for limiting longitudinal movement of said equalizing piston.

30. A releasing apparatus for a downhole tool, said apparatus comprising:

a neck portion for connecting to the downhole tool, said neck portion defining a substantially transverse opening therethrough;

releasing mandrel means for sliding within said neck portion, said releasing mandrel means defining a mandrel groove in an outer surface thereof, said mandrel groove being initially spaced from said opening in said neck portion;

overshot means disposed around said neck portion for connecting to a coiled tubing unit, said overshot means defining an overshot groove therein;

locking dog means disposed in said opening for initially engaging said overshot groove, said locking dog means comprising biasing means for biasing said locking dog means toward said releasing mandrel means; and releasing means for engaging and moving said releasing mandrel means in response to a pressure, whereby said mandrel groove is aligned with said opening such that said locking dog means is moved to engage said mandrel groove and is disengaged from said overshot groove, thereby releasing said overshot means from said neck portion.

31. The apparatus of claim 30 wherein said locking dog means comprises a spring biased locking dog.

32. The apparatus of claim 30 further comprising shearing means for shearably attaching said releasing mandrel means to said neck portion.

33. The apparatus of claim 30 wherein said releasing means is characterized by a releasing plug which latchingly engages said releasing mandrel means.

34. The apparatus of claim 33 wherein said plug has a flexible portion.

35. The apparatus of claim 30 wherein said releasing means is characterized by a releasing ball.

36. The apparatus of claim 30 wherein said neck portion comprises a retrieving neck engagable by a downhole retrieving tool.

* * * * *